US008099883B2

(12) United States Patent
Mestres Armengol et al.

(10) Patent No.: US 8,099,883 B2
(45) Date of Patent: Jan. 24, 2012

(54) COLLAPSIBLE, SELF-EXPANDING DISPLAY UNIT AND PUSH ELEMENT FOR THE EXPANSION THEREOF

(75) Inventors: Fernando Mestres Armengol, Barcelona (ES); Francisco López Fernandez, Barcelona (ES)

(73) Assignee: Promotec Publicidad, S.L., Barcelona (ES)

( * ) Notice: Subject to any disclaimer, the term of this patent is extended or adjusted under 35 U.S.C. 154(b) by 121 days.

(21) Appl. No.: 12/759,181

(22) Filed: Apr. 13, 2010

(65) Prior Publication Data

US 2010/0236117 A1 Sep. 23, 2010

Related U.S. Application Data

(63) Continuation-in-part of application No. 11/820,627, filed on Jun. 20, 2007, now Pat. No. 7,726,054, which is a continuation-in-part of application No. PCT/ES2005/000695, filed on Dec. 21, 2005.

(51) Int. Cl.
*A47G 1/14* (2006.01)

(52) U.S. Cl. ..... 40/124.07; 40/539; 40/603; 40/606.12; 40/607.02; 40/610

(58) Field of Classification Search ..... 40/539, 40/610, 124.08, 124.14, 606.12; 434/430; 446/80, 227, 482, 488
See application file for complete search history.

(56) References Cited

U.S. PATENT DOCUMENTS

| | | | |
|---|---|---|---|
| 2,160,724 | A | 11/1937 | Fletcher |
| 3,234,682 | A | 2/1966 | Frankl |
| 5,212,898 | A | 5/1993 | Dinan et al. |
| 5,787,621 | A | 8/1998 | Leksell |
| 5,966,857 | A | 10/1999 | Pettersson et al. |
| 6,347,772 | B1 | 2/2002 | L'Hotel |
| 6,896,577 | B1 | 5/2005 | Feng |

FOREIGN PATENT DOCUMENTS

| | | | |
|---|---|---|---|
| FR | 2.210.317 | | 7/1974 |
| FR | 2 691 621 | | 12/1993 |
| GB | 2 370 997 | A | 7/2002 |
| WO | WO 02/095719 | A2 | 11/2002 |
| WO | WO 2004/027737 | A1 | 4/2004 |

OTHER PUBLICATIONS

International Search Report for International Application No. PCT/ES2005/000695, Mar. 21, 2006, Promotec Publicidad, S.L.

*Primary Examiner* — Joanne Silbermann
*Assistant Examiner* — Shin Kim
(74) *Attorney, Agent, or Firm* — RatnerPrestia

(57) ABSTRACT

The invention relates to a display unit including of two panels which are joined along the lateral edges thereof, and at least one push unit joined to one of the panels and including first and second edges wherein at least the second edge is a free edge. The inventive display unit can be collapsed, whereby the element and the panels are disposed back-to-back adopting a flat configuration. The invention also includes a pull element intended to rotate, curve or bend the push element thereby pushing the free second edge of the push element towards one of the two panels in order to expand the panels automatically from the collapsed configuration to a service position in which the display unit it adopts a convex configuration able to stand upright.

14 Claims, 18 Drawing Sheets

COLLAPSIBLE, SELF-EXPANDING DISPLAY UNIT AND PUSH ELEMENT FOR THE EXPANSION THEREOF

This application is a Continuation-in-Part of application Ser. No. 11/820,627 filed on Jun. 20, 2007 which is Continuation-in-Part of PCT International Application No. PCT/ES2005/000695, filed Dec. 21, 2005 designating the U.S., and in which priority is hereby claimed.

TECHNICAL FIELD

The present invention relates to a collapsible and self-expanding display unit of the type that is adapted to be arranged in a folded position, in which it adopts a flat configuration, and comprising expansion means, including at least one pull element, adapted to expand said display unit in a service position, in which it adopts a convex configuration and can stand upright.

The present invention also relates to a push element that can be applied to the expansion of said collapsible, self-expanding display unit.

STATE OF THE PRIOR ART

Patent document FR-A-2210317, of public domain, discloses a collapsible, self-expanding display unit comprising a panel divided by longitudinal folding lines in five portions. The mentioned panel is folded by said folding lines and assembled such that four of said portions form a rhombic prism and the fifth portion is arranged diagonally between two opposite edges of said prism. One or more pull elements, such as elastic bands, are arranged to attract the mentioned opposite edges of the prism towards one another so as to expand the panel from a collapsed situation to a three-dimensional arrangement that can stand upright in a service position.

Patent document U.S. Pat. No. 6,347,772 describes a collapsible, self-expanding display unit comprising, in a first variant, a panel having a first lateral edge from which flaps extend and a second lateral edge from which corresponding extensions extend, the free ends of which are elastically connected to said flaps adjacent to the first lateral edge of the panel. The mentioned elastic connections are carried out by means of annular elastic bands held by corresponding engagement configurations.

In a second variant, the mentioned patent document U.S. Pat. No. 6,347,772 describes a collapsible, self-expanding display unit comprising two equal, opposite panels having respective first and second lateral edges from which respective first and second extensions extend from the same piece.

A drawback of both variants is that the convex arched configuration which the panel or panels adopt in the expanded situation is not very solid, since there is not a supporting element for the inner face of the panel or panels. Furthermore, when the display unit is in the expanded position, the elastic bands connecting the lateral edges of the panel or panels are relatively loose and the joining between the flaps and the extensions of the panel, or between the flaps of the two panels, may be loose. For this reason, sometimes it is appropriate to provide some joining areas by means of adhesive between the flap and the extensions of the panel, or between the flaps of the two panels. In addition, the structure of the bracket or pedestal-shaped foot provides relatively little stiffness, whereby it can be relatively effective in contributing to support small or medium sized display units, but it may be weak in contributing to supporting large, heavy or tall display units.

SUMMARY OF THE INVENTION

The present invention provides a folder made of a laminar material located next to an inner face of one of the panels and provided with an inlet communicated with an opening formed in the panel, said folder being suitable for housing, at least in part, items such as sheets of paper, brochures, and the like.

All the elements of the display unit and of the push element of the present invention are suitable for being made from a laminar material such as cardboard or a sheet of plastic, though it is not limited to them.

BRIEF DESCRIPTION OF THE DRAWINGS

The previous and other advantages and features will be better understood based on the following detailed description of several embodiments in reference to the attached drawings, in which.

DETAILED DESCRIPTION OF EXEMPLARY EMBODIMENTS

Figure 1:
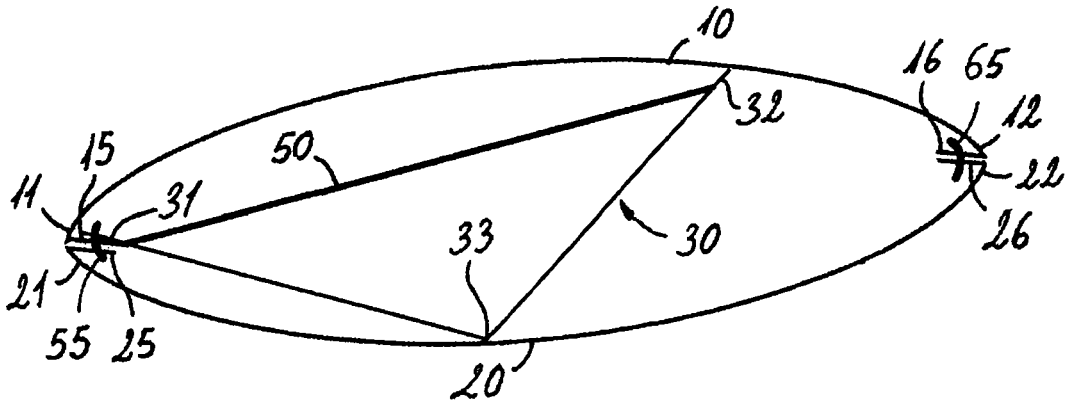
FIG. 1 is a schematic plan view of a collapsible, self-expanding display unit according to an embodiment of the present invention in a service position.

First in reference to FIG. 1, the collapsible, self-expanding display unit according to an embodiment of the present invention comprises two opposite panels 10, 20 joined along their respective lateral edges 11, 12 and 21, 22. In a collapsed situation (not shown) these two panels 10, 20 adopt a flat configuration, whereas in a service position they adopt a convex configuration (FIG. 1). In the mentioned convex configuration, the two panels 10, 20 are arched towards opposite directions, whereby the lower edges of the panels 10, 20 provide a base that can keep display unit upright. Throughout this specification, the terms "up", "down", "upper", "lower", "lateral", and derivatives thereof, use the display unit when it is in its upright position as the positional reference.

The display unit includes expansion means adapted to automatically expand said panels 10, 20 from the mentioned collapsed situation to said service position. In this first embodiment, the mentioned expansion means comprise a push element 30 in the form of a sheet having a first edge 31 joined to at least one of the two panels 10, 20 and a free second edge 32 distal from said first edge 31. When the display unit is in said collapsed situation, the mentioned push element 30 adopts a flat configuration together with the two panels 10, 20. A pull element 50 is arranged to rotate, curve or bend the push element 30 and, in this way, to push said free second edge 32 of the push element 30 towards one of the two panels 10, 20, for example, towards the first panel 10, causing an automatic expansion of the panels 10, 20 from the collapsed situation to the service position shown in FIG. 1.

In the embodiment of FIG. 1, the push element 30 further comprises a bend line 33 located between said first and second edges 31, 32 and parallel thereto. The pull element 50, which can be, for example, a conventional annular elastic band, is arranged to attract the free second edge 32 towards the first edge 31 by bending the push element 30 along said bend line 33, such that an edge coinciding with the bend line 33 moves towards the other one of the panels 10, 20, i.e. towards the second panel 20 opposite to the first panel 10 towards which the free second edge 32 is pushed. In this way, the two panels 10, 20 are pushed by the push element 30 towards opposite directions.

The panels 10, 20 have first and second flaps 15, 16 and 25, 26 extending respectively from their mentioned lateral edges 11, 12 and 21, 22. These first and second flaps 15, 16 and 25, 26 are turned inwards, mutually opposite and joined to one another. The push element 30 is housed between the two panels 10, 20 and its first edge 31 is joined to at least one of the first opposite flaps 15, 25 joined to the panels 10, 20, although it could obviously be joined to at least one of the second flaps 16, 26 with the same result.

Figure 2:
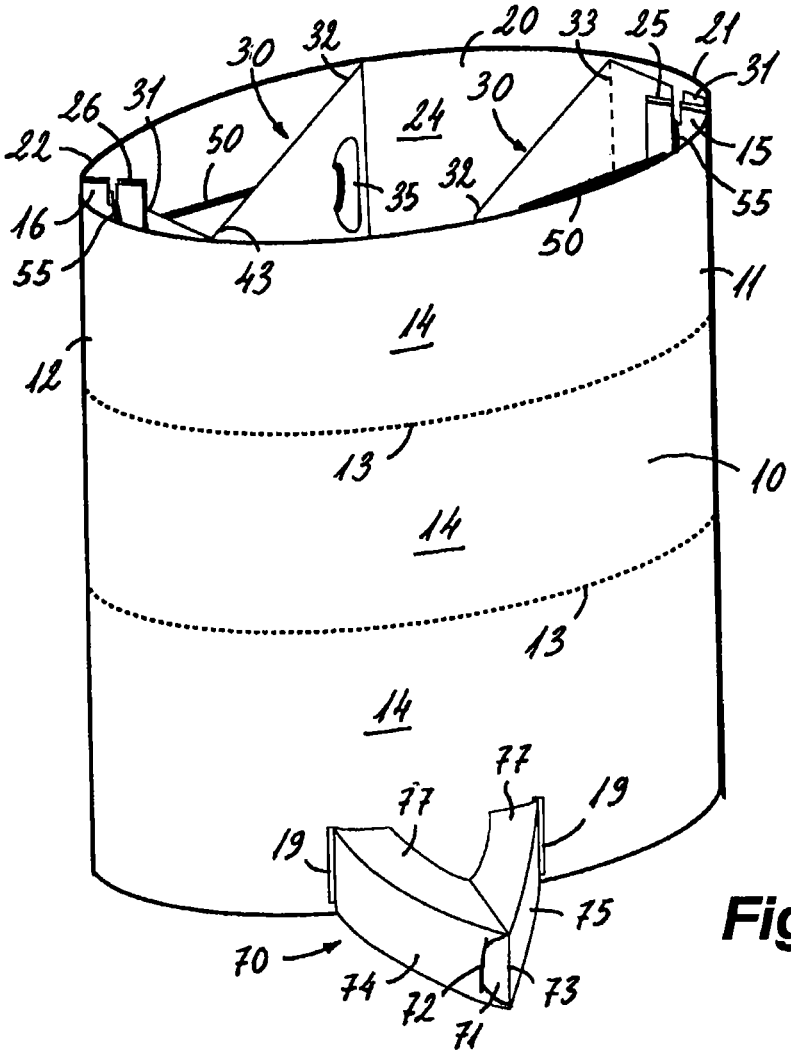
FIG. 2 is a schematic perspective view of another embodiment of the collapsible, self-expanding display unit of the present invention in a service position.
Figure 2A:
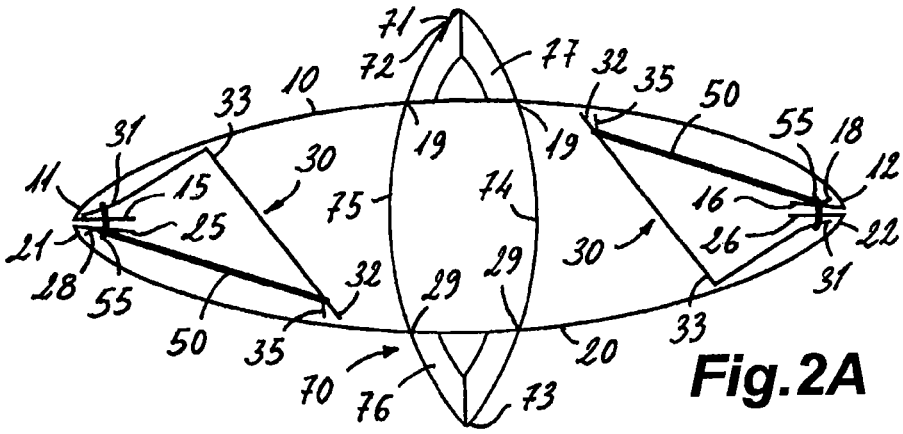
FIG. 2A is a schematic plan view of the display unit of FIG. 2.

Preferably, according to the embodiment of FIGS. 2 and 2A, the display unit comprises at least one first push element 30 joined to the first flaps 15, 25 of the panels 10, 20 and at least one second push element 30 joined to the second flaps 15, of the panels 10, 20. These first and second push elements 30 are similar to the push element 30 described above in relation to FIG. 1. It will be understood that even though FIGS. 2 and 2A show the first and second push elements 30 arranged to push the first panel 10 with the bend line 33 of one of them and the free second edge 32 of the other one and the second panel 20 with the free second edge 32 of one of them and the bend line 33 of the other one, they could also be arranged to both push with the irrespective bend lines 33 the first panel 10 and with their respective free second edges 32 the second panel 20 with an equivalent result.

Figure 3:
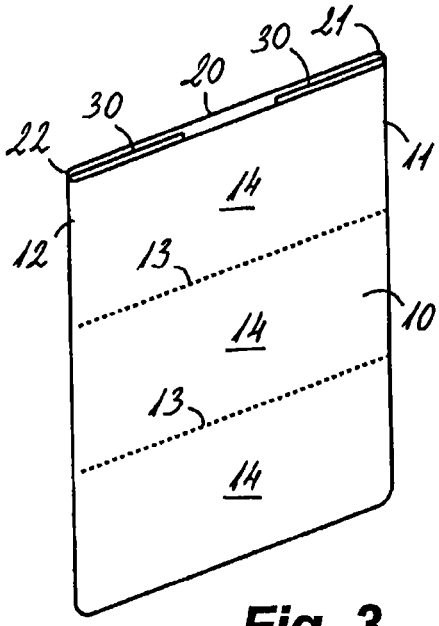
FIG. 3 is a schematic perspective view of the display unit of FIG. 2 in a collapsed situation.
Figure 4:
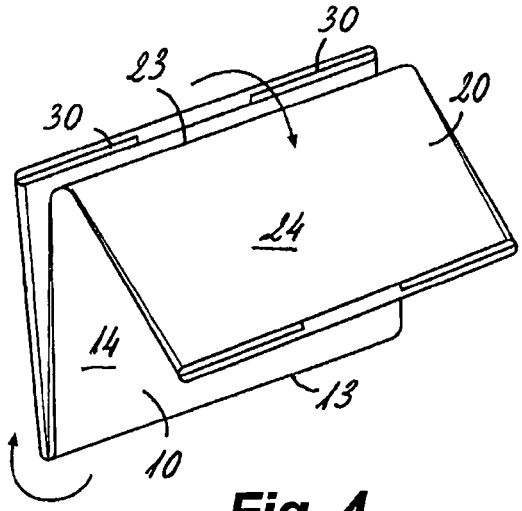
FIG. 4 is a schematic perspective view illustrating the display unit going from the collapsed situation of FIG. 3 to a folded position.

By externally pressing on the first and second panels 10, 20, the display unit can be forced to adopt a collapsed situation shown in FIG. 3, in which the first and second panels 10, 20 are arranged back-to-back, adopting a flat configuration, with the first and second push elements 30, also flattened and housed between the two panels 10, 20. In this collapsed situation, the first and second pull elements 50 remain stretched and exerting greater pull than in the service position, therefore the display unit tends to spontaneously adopt the expanded position shown in FIGS. 2 and 2A. The first and second panels 10, 20 further comprise respective transverse bend lines 13, 23 extending from the first lateral edge 11, 21 to the second lateral edge 12, 22, dividing the respective first and second panels 10, 20 into several mutually opposite portions 14, 24. The display unit preferably comprises at least one pair of first and second push elements 30 for every pair of mutually opposite portions 14, 24 of the first and second panels 10, 20. As a result, the display unit can be folded by bending it along said transverse bend lines 13, 23 from the mentioned collapsed situation shown in FIG. 3 to a folded position shown in FIG. 4, in which the display unit adopts a flat configuration with said portions 14, 24 mutually overlapping. Due to such folding, the display unit is stable in the mentioned folded position of FIG. 4 despite the pulling exerted by the pull elements 50.

Figure 5:
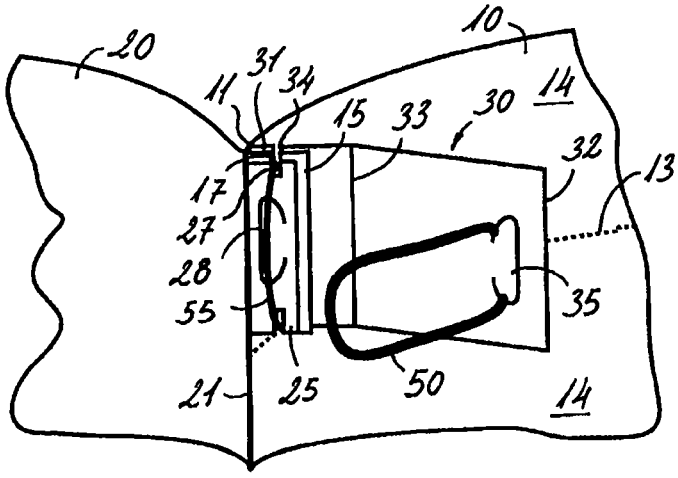
FIG. 5 is a partial schematic perspective view showing partially open first and second panels of the display unit to show the push element.

Still in relation to FIG. 2, the first and second panels 10, 20 comprise, in each of said portions 14, 24, respective first mutually opposite flaps 15, 25 extending from the respective first lateral edges 11, 21 and respective second mutually opposite flaps 16, 26, extending from the respective second lateral edges 12, 22. As is best seen in the detail of FIG. 5, in every pair of said first and second mutually opposite flaps 15, 25; 16, 26 respective first and second connecting configurations 17, 27 are arranged cooperating with joining elements 55 so as to carry out the mentioned mutual connection of the first lateral edges 11, 21 of the first and second panels 10, 20, and the mentioned mutual connection of the second lateral edges 12, 22 of the first and second panels 10, 20. In the embodiment illustrated in FIG. 5, the first and second connecting configurations 17, 27 are notches and said joining elements 55 are annular elastic bands, available on the market at a low cost, interlocked in said notches. Each of the first and second push elements 30 also has a respective connecting configuration 34, for example, in the form of notches, adapted to cooperate with the elastic bands forming the joining elements 55 to carry out the mentioned connection of the first edge 31 of the first push element 30 to the respective first lateral edges 11, 21 of the first and second panels 10, 20, and the connection of the first edge 31 of the second push element 30 to the second lateral edges 12, 22 of the first and second panels 10, 20. The distribution of forces between the joining elements 55, pull elements 50, push elements 30 and panels 10, 20 makes the first lateral edges 11, 21 and the second lateral edges 12, 22 of the first and second panels 10, 20 tend to be pressed against one another, so the panels 10, are joined by the joining elements 55 without having to apply adhesive or any other additional joining means between the mentioned first mutually opposite flaps 15, 25, and second mutually opposite flaps 16, 26 of the panels 10, 20.

Alternatively, in an embodiment not shown, each of the first and second push elements 30 is integral respectively with one of the first flaps 15, 25 and with one of the second flaps 16, 26 of the first and second panels 10, 20. For example, the first push element 30 may be integral with the first flap 15 of the first panel 10 and the second push element 30 may be integral with the second flap 26 of the second panel 20, or both first and second push elements 30 could both form part of the first panel 10 or both form part of the second panel 20. Here, the connection of the first lateral edges 11, 21 to one another, and the connection of the second lateral edges 12, 22 to one another, of the first and second panels 10, 20, is carried out by means of respective joining elements 55, for example, in the form of an elastic band, in a manner similar to that described above in relation to FIG. 5.

Each of the first and second push elements 30 has a first engagement configuration 35 located in the second edge 32, or between the second edge 32 and said bend lines 33, to engage a first end of said pull element 50, whereas second engagement configurations 18, 28, located respectively in at least one of the first mutually opposite flaps 15, 25, and in at least one of the second mutually opposite flaps 16, 26, are arranged to respectively engage a second end of the pull elements 50, as is best seen in FIG. 5.

Optionally, even though in FIGS. 2 and 2A the display unit has a sufficient base so as to hold itself upright without difficulties, to additionally increase the stability of the display unit the incorporation of a foot 70 has been provided, which foot is shown in the operative position in FIGS. 2 and 2A. The mentioned foot 70 is made from a strip of laminar material divided into at least two portions 74, 75 by a bend line 73. The strip has opposite ends in which respective mutual joining configurations 71, 72 are arranged, such that the mentioned two portions 74, 75 are suitable for being passed through respective substantially vertical separated grooves 19 of the first panel and of substantially vertical separated grooves 29 formed in the second panel and to then be mutually joined at their ends by means of said mutual joining configurations 71, 72. Preferably, the strip of laminar material forming the foot 70 further comprises a first pair of overlaps 76 extending from areas of their upper edge adjacent to their ends and a second pair of overlaps 77 extending from areas of their upper edge adjacent to said bend line 73. The overlaps of each first and second pair of overlaps 76, 77 are adapted to be bent and arranged in a substantially horizontal position. Additionally, the overlaps of each first and second pair of overlaps 76, 77 include respective folding lines which allow bending the overlaps to provide flaps acting like mutually opposite stops increasing the structural stiffness of the foot 70. Due to the particular structure of the foot 70, the latter folds automatically with the panels when the display unit is arranged in its collapsed situation, and automatically unfolds when the display unit is arranged in its expanded configuration.

The display unit according to the embodiments shown in FIGS. 1, 2 and 2A has, seen in plan view in the service position, a substantially pointed or oval shape. However, a display unit with two panels 10, 20 according to a variant not shown of this first embodiment may have a substantially prismatic configuration in said service position. To that end, each of the first and second panels 10, 20 comprises one or more longitudinal bend lines parallel to the first and second lateral edges 11, 21; 12, 22. As a result, the first and second panels 10, 20 are adapted to be bent along said longitudinal bend lines 13, 23 so as to adopt a substantially prismatic configuration. For example, if each panel 10, 20 includes a single longitudinal bend line 13, 23 in a central position, the display unit adopts, when seen in plan view, a square or rhombic configuration. If, according to another example, each panel 10, 20 includes two longitudinal bend lines approximately equidistant to one another and equidistant to the first and second lateral edges 11, 21; 12, 22, the display unit adopts, when seen in plan view, a hexagonal configuration.

Figure 6A:
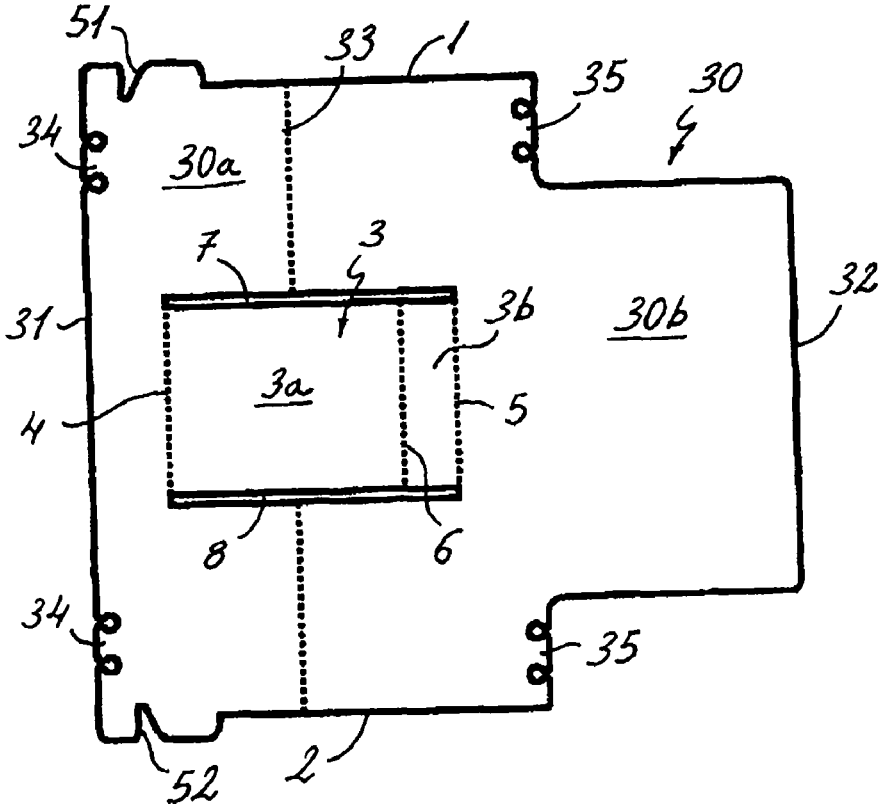
FIG. 6A is a plan view of a sheet forming part of an embodiment of the push element of the present invention, in a flat arrangement.
Figure 6B:
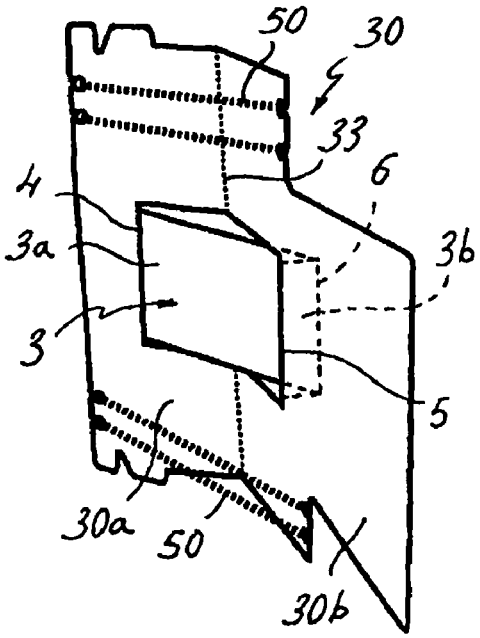
FIGS. 6B and 6C are perspective views respectively showing opposite sides of the push element constructed from the sheet of FIG. 6A, in a three-dimensional arrangement.
Figure 6C:
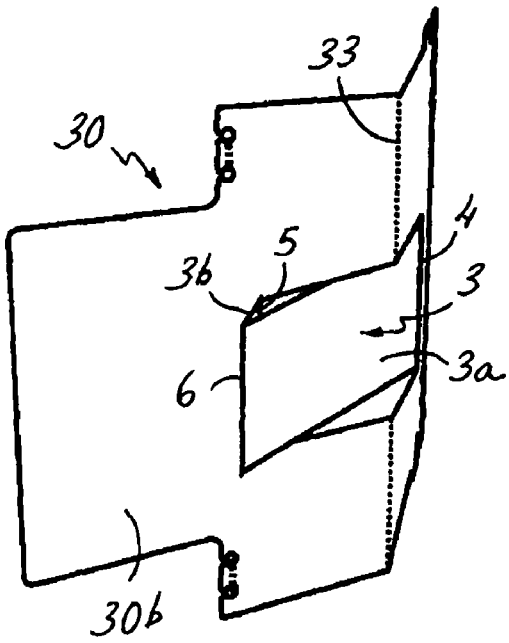

FIGS. 6A-6C describe another embodiment of the push element of the present invention. FIG. 6A shows a sheet forming part of the push element 30, and comprising first and second opposite lateral edges 31, 32 connected along at least two upper and lower opposite edges 1, 2. A main bend line 33 dividing said push element 30 into first and second portions 30*a*, 30*b* extends from one to the other of said other two upper and lower opposite edges 1, 2, and arranged next to the first opposite edges 31, 32 there are arranged two pairs of engagement configurations 34, adapted to engage respective ends of pull elements 50, represented in FIG. 6B. The pull elements 50 are thus arranged so as to attract said first and second portions 30*a*, 30*b* of the push element 30 towards one another, bending it along said main bend line 33. In this way, the push element 30 can go from a flat arrangement, as shown in FIG. 6A, to a three-dimensional arrangement, as shown in FIGS. 6B and 6C, in which the two portions 30*a* and 30*b* of the push element 30 form an angle with one another. For the purpose of limiting the mentioned angle formed by the first and second portions 30*a*, 30*b* when the push element 30 adopts its three-dimensional arrangement, the structural element incorporates a limiting member 3 that can adopt a flat arrangement when the push element 30 is in its flat arrangement.

In the embodiment of FIGS. 6A-6C, the limiting member 3 is obtained by die-cutting from the same sheet as the push element 30, said sheet of material being relatively stiff, for example, cardboard. To that end, the push element 30 comprises two cuts 7, 8 crossing the main bend line 33 at different heights defining opposite edges of the limiting member 3. The main bend line 33 is interrupted between said two cuts 7 and 8. End bend lines 4, 5 extend from the ends of one of the cuts 7, 8 to the ends of the other one of the cuts 7, 8, which end bend lines form end articulations 4, 5 parallel to the main bend line 33. An intermediate bend line 6 extends from one to the other of the cuts 7, 8, which intermediate bend line, forming an intermediate articulation 6 parallel to the main bend line 33 and misaligned in relation thereto, divides said limiting member 3 into first and second portions 3*a*, 3*b*. When the push element 30 goes from said flat arrangement to said three-dimensional arrangement, the limiting member 3 rotates with respect to said end articulations 4, 5 and bends along said intermediate articulation 6.

Therefore, when the push element 30 goes from its flat arrangement to its three-dimensional arrangement, said first portion 3*a* of the limiting member 3 is pushed by the first portion 30*a* of the push element 30 towards the second portion 30*b*, until the second portion 3*b* of the limiting member 3 prevents its subsequent movement, at which time the limiting member 3 forms a resistant bridge between the first and second portions 30*a*, 30*b* of the push element 30 against the push of said pull element 50, limiting in this way said angle formed between both. The limit angle formed by the first and second portions 30*a*, 30*b* of the sheet may be geometrically determined by playing with the distances from the main bend line 33 to the end articulations 4, 5, and the distances from the intermediate articulation 6 to the end articulations 4, 5.

Note that in any arrangement of the push element 30, from its flat arrangement to its three-dimensional arrangement, the plane of the limiting member 30 remains substantially parallel to the main bend line 33. This is because all the mentioned articulations 4, 5, 6 of the limiting member 3 are parallel to the main bend line 33, facilitating the automatic unfolding or assembly of the structural element and the manual folding thereof by pressing on the first and second portions 30*a*, 30*b* of the push element 30 against the force of the elastic element 50 to place both the push element 30 and the limiting member 3 in the flat arrangement. Given that all the bend lines forming the articulations 4, 5, 6, 33 are advantageously made on the same side of the piece, both the push element 30 and the limiting member 3 have the tendency to bend towards the same side.

The construction of the example of FIGS. 6A-6C allows multiple variations. For example, it could incorporate a single pull element 50, or more than two, and the corresponding engagement configurations 34, 35 could be located in other positions different from those shown, for example, between the corresponding second opposite edge 31, 32 and said main bend line 33. More than one limiting member 3 could also be incorporated, and the proportions between its first and second portions 3*a*, 3*b* could be different, being irregardless that the longest one is the first or the second one. Several examples of the application of the structural element of the present invention are described below. Optionally, the limiting member 3 could be made of an independent piece provided, for example, with overlaps (not shown) next to the end articulations, adapted to be adhered to the push element 30 with the limiting member 3 being extended from side to side of a window formed in the push element 30.

Figure 7:
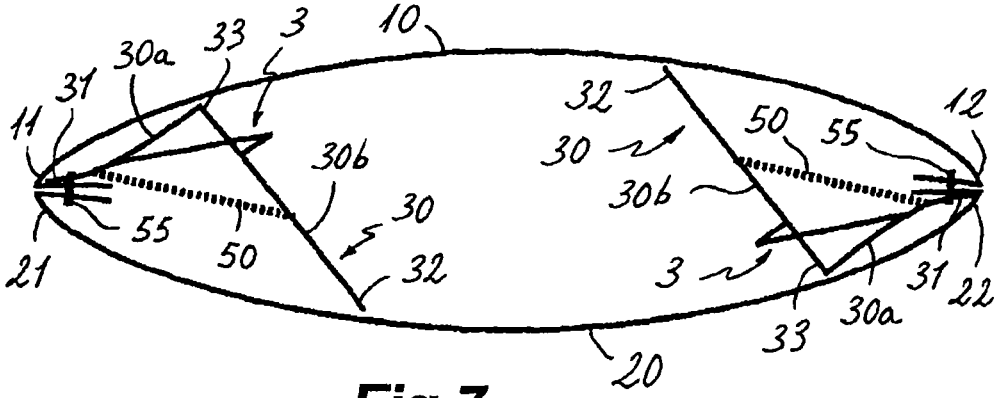
FIG. 7 is a schematic plan view showing the push element of FIGS. 6A-6C applied to a collapsible, self-expanding display unit provided with two expanding panels.

FIG. 7 shows push elements 30 according to the embodiment described in relation to FIGS. 6A-6C applied to the expansion of a collapsible, self-expanding display unit similar to the one described in FIG. 2. Each push element 30 comprises, next to its first edge 31, which is linked to the corresponding first or second lateral edges 11, 21; 12, 22 of the panels 10, 20, connecting configurations 51, 52 (see FIG. 6A) adapted to engage the joining element 55 in the form of an elastic band arranged to carry out the mutual connection of the first and second flaps 15, 25; 16, 26 adjacent to the corresponding first or second lateral edges 11, 21; 12, 22 of the panels 10, 20, in a manner similar to that described above in relation to FIG. 5.

Therefore, the force of the elastic members 50 of the push elements of the present invention acts to unfold the display unit from a collapsed situation, in which it adopts a flat configuration, to a service position, in which it adopts a convex configuration, due to the push of an edge coinciding with the main bend line 33 of the push element 30 against one of the panels 10, 20 in one direction and due to the push of the other one of the first opposite edges 32 of the push element 30 against the other one of the panels 10, 20 in an opposite direction. The limiting members 3 of the push elements of the present invention act to limit the angle formed by the first and second portions 30*a*, 30*b* of the push element 30, determining in this way the degree of expansion of the first and second panels 10, 20 and preventing an unwanted additional gradual expansion of the display unit over time.

Figure 8A:
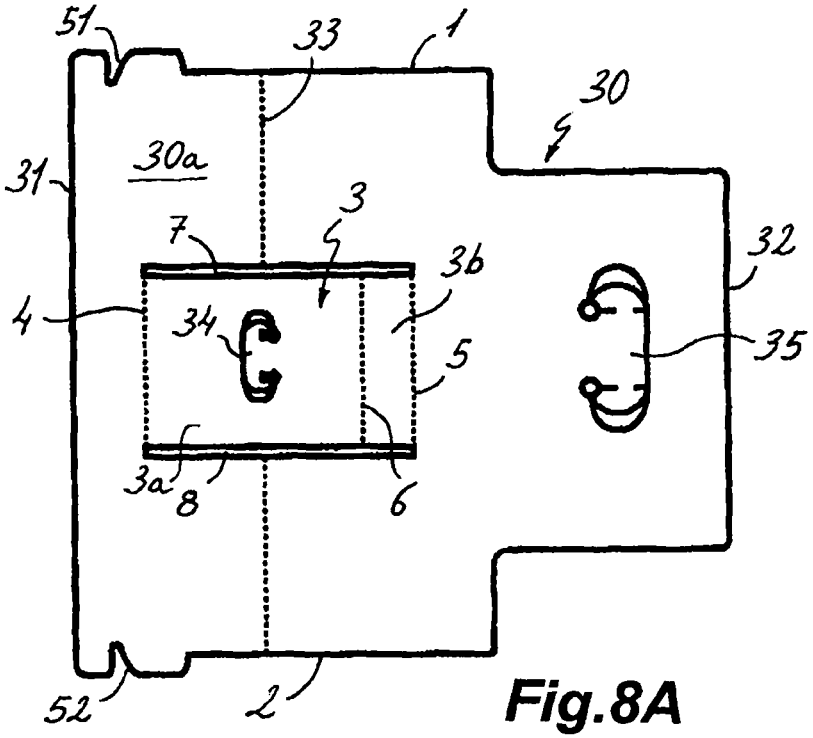
FIG. 8A is a plan view of a sheet forming part of another embodiment of the push element of the present invention, in a flat arrangement.
Figure 8B:
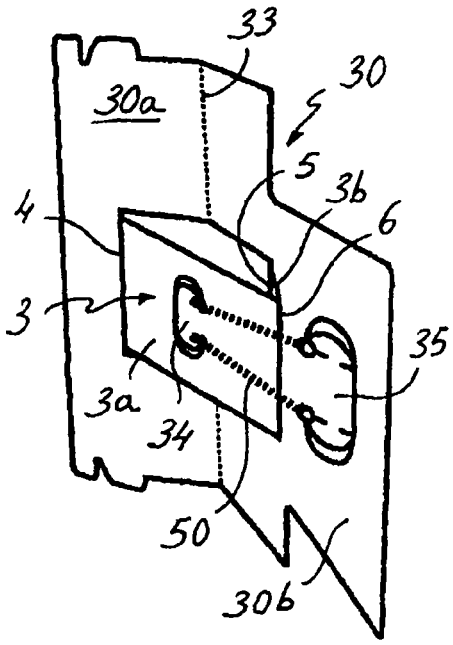
FIGS. 8B and 8C are perspective views showing respectively opposite sides of the push element constructed from the sheet of FIG. 8A, in a three-dimensional arrangement.
Figure 8C:
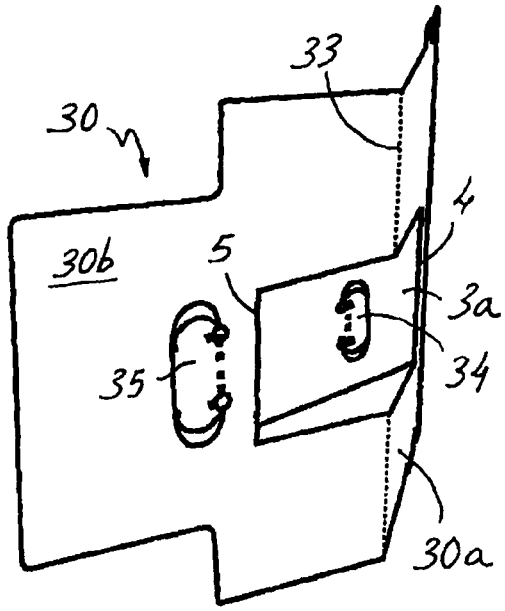

FIGS. 8A-8C show another embodiment provided so that the push element 30 and the limiting member 3 bend towards opposite sides. This embodiment of FIGS. 8A-8C is completely similar to the embodiment described in relation to FIGS. 6A-6C, except in that it has only one pair of engagement configurations 34, 35 to engage a pull element 50, and that one of such engagement configurations 34 is formed in the first portion 3*a* of the limiting member 3. With this construction, it is assured that the limiting member 3 bends along the intermediate articulation 6 inwardly of the angle formed by the first and second portions 30*a*, 30*b* of the push element 30, thus preventing the limiting member 3 from projecting on the opposite side, as occurs with the first embodiment, which can be advantageous in certain applications. Optionally, the limiting member 3 could be made of an independent piece provided, for example, with overlaps (not shown) next to the end articulations, adapted to be adhered to the push element 30.

In relation to FIGS. 9A-9C, another embodiment of the push element 30 of the present invention is described below in which the limiting member functions according to a principle different from the one described above. In this embodiment of FIGS. 9A-9C, the push element 30 includes first and second opposite lateral edges 31, 32 connected by at least two other upper and lower opposite edges 1, 2. A main bend line 33 extends from one to the other of these upper and lower opposite edges 1, 2, dividing said push element 30 into first and second portions 30*a*, 30*b*, and two pairs of engagement configurations 34, 35 are arranged next to the first lateral opposite edges 31, 32 adapted to engage respective ends of pull elements 50, represented in FIG. 9B. The pull elements 50 are thus arranged to attract said first and second portions 30*a*, 30*b* of the push element 30 towards one another, bending it along said main bend line 33. The limiting member 103 here is formed as an independent piece of a relatively rigid laminar material having at its opposite ends respective sliding portions 105, 106 adapted to be inserted in a sliding manner in corresponding guide cuts 48, 49 existing in both the first and second portions 30*a*, 30*b* of the push element 30. These guide cuts 48, 49 are parallel to the main bend line 33. The limiting member 103 includes stop configurations 107, 108 arranged to limit the insertion of the mentioned sliding portions 105, 106 in the guide cuts 48, 49 of the push element 30.

With this construction, when the push element 30 goes from its flat arrangement to its three-dimensional arrangement, the limiting member 103 is pushed in an undetermined manner by the first portion 30*a* or by the second portion 30*b* of the push element 30, i.e. by that of the first or second portions 30*a*, 30*b* first interfering with any of the stop configurations 107, 108 of the limiting member 103, until the other one of the first or second portions 30*a*, 30*b* of the push element 30 interferes with the other stop configurations 107, 108 of the limiting member 103, at which time the limiting member 103 forms a resistant bridge between the first and second portions 30*a*, 30*b* of the push element 30 against the push of said pull element 50, limiting in this way the angle formed between both first and second portions 30*a*, 30*b*. The limit angle can be determined geometrically playing with the distances from the main bend line 33 to the guide cuts 48, 49, in the push element 30, in combination with the distances between the stop configurations 107, 108 in the limiting member 103.

Figure 9A:
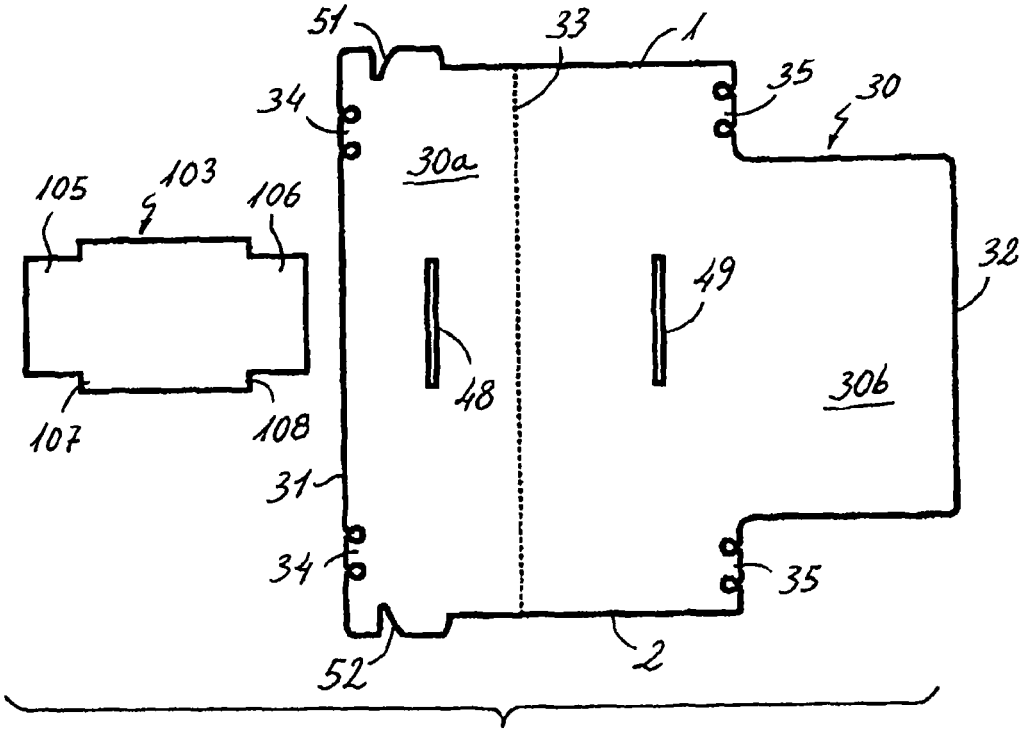
FIG. 9A is a plan view of a sheet forming part of yet another embodiment of the push element of the present invention, in a flat arrangement.
Figure 9B:
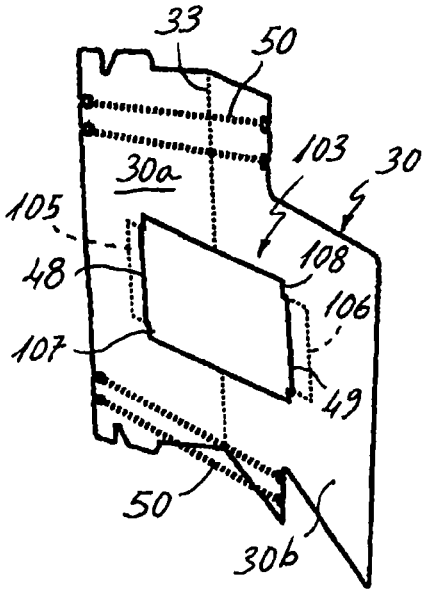
FIGS. 9B and 9C are perspective views respectively showing opposite sides of the push element constructed from the sheet of FIG. 9A, in a three-dimensional arrangement.
Figure 9C:
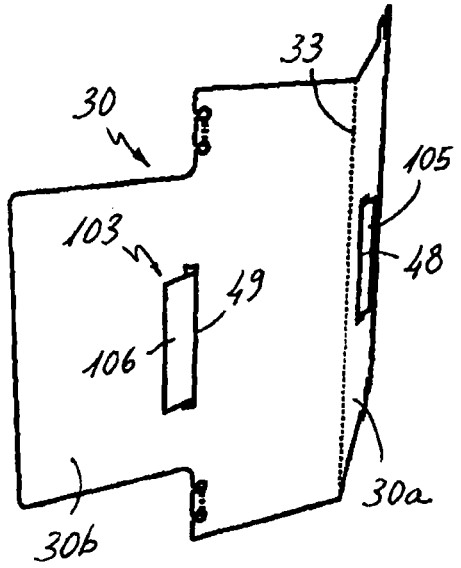

The construction of the embodiment shown in FIGS. 9A-9C allows multiple variations. For example, it could incorporate a single pull element 50, or more than two of them, and the corresponding engagement configurations 34, 35 could be located in other positions different from those shown, for example, between the corresponding second opposite edge 31, 32 and said main bend line 33. It could further incorporate more than one limiting member 103, and the stop configurations 107, 108 could be different from those shown.

Figure 10A:
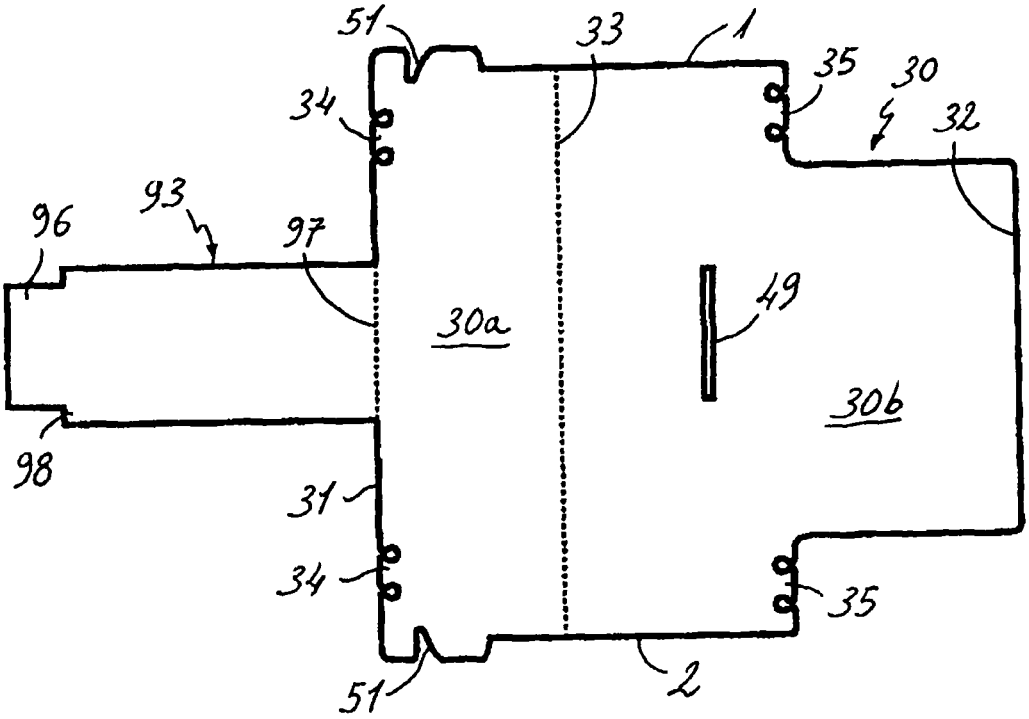
FIG. 10A is a plan view of a sheet forming part of another additional embodiment of the push element of the present invention, in a flat arrangement.
Figure 10B:
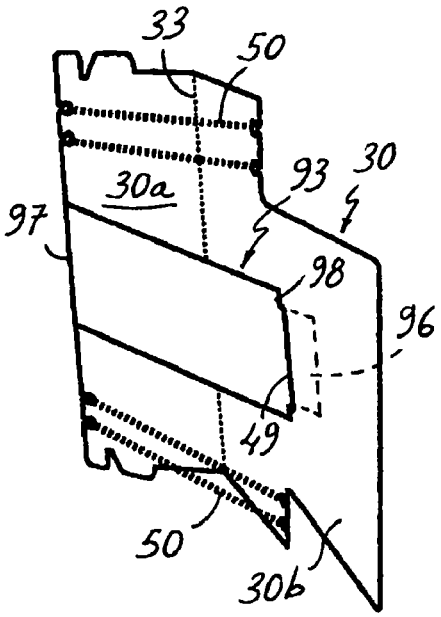
FIGS. 10B and 10C are perspective views respectively showing opposite sides of the push element constructed from the sheet of FIG. 10A in a three-dimensional arrangement.
Figure 10C:
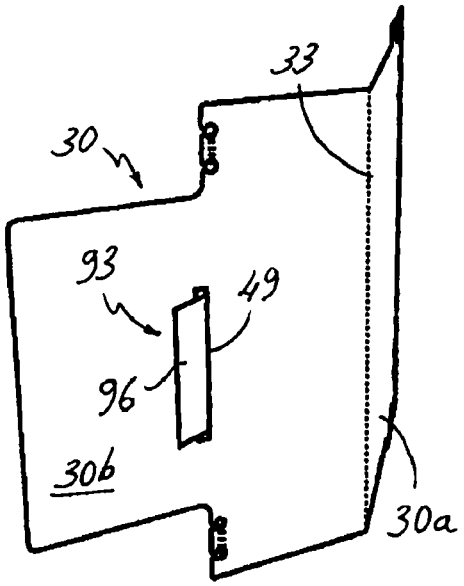

FIGS. 10A-10C show another additional embodiment of the push element 30 of the present invention, in which the limiting member works according to a principle which is a combination of that of the embodiments described above in relation to FIGS. 6A-6C and 9A-9C, respectively. In this additional embodiment, the limiting member 93 is formed integrally of the same piece as the push element 30. This limiting member 93 has at one of its ends an edge which is connected to one of the first and second portions 30*a*, 30*b* of the push element 30 by means of an end articulation 97 formed by an end bend line 97 parallel to the main bend line 33. At its other end, the limiting member 93 includes a sliding portion 96 adapted to be inserted in a sliding manner in a guide cut 49 parallel to the main bend line 33 existing in the other one of the first and second portions 30*a*, 30*b* of the push element 30. The limiting member 103 comprises one or more stop configurations 98 arranged to limit the insertion of said sliding portion 96 in said guide cut 49.

Therefore, when the push element 30 goes from its flat arrangement to its three-dimensional arrangement, the limiting member 93 is pushed by the first portion 30*a* of the push element 30 towards the second portion 30*b* with the sliding portion 96 being inserted through the guide cut 49, until the second portion 30*b* of the push element 30 interferes with stop configurations 98 of the limiting member 93, preventing its subsequent insertion, at which time the limiting member 93 forms a resistant bridge between the first and second portions 30*a*, 30*b* of the push element 30 against the push of said pull element 50, limiting in this way said angle formed between both. The limit angle can be determined geometrically by playing with the distances from the main bend line 33 to the end articulation 97 and to the guide cut 49, in combination with the distance from the end articulation 97 to the stop configurations 98.

The construction of the embodiment of FIGS. 10A-10C allows multiple variations. For example, it could incorporate a single pull element 50, or more than two, and the corresponding engagement configurations 34, 35 could be located in other positions different from those shown, for example, between the corresponding second opposite edge 31, 32 and said main bend line 33. It could also incorporate more than one limiting member 93, and the stop configurations 98 could be different from those shown. The end articulation 97 could be located between one of the first edges 31 and the main bend line 33, in which case a corresponding portion of the limiting member would be separated from the first portion 30*a* of the sheet by several cuts (not shown). Optionally, the limiting member 93 could be made of an independent piece provided, for example, with a flap (no shown) next to the end articulation, adapted to be adhered to the push element 30.

Similarly to that described above in relation to FIGS. 2, 3 and 4, the first and second panels 10, 20 of the display unit may optionally include transverse folding lines 13, 23 which allow zigzag folding of the display unit from its collapsed situation. In such case, at least one pair of push elements 30 such as those described in FIGS. 6A-6C, 8A-8C, 9A-9C and 10A-10C could be incorporated between every two mutually opposite portions 14, 24 of the panels 10, 20 defined by said transverse bend lines 13, 23. It must be pointed out that even though push elements 30 are shown in the example of application in FIG. 7 according to the embodiment of FIGS. 6A-6C, the push elements of the embodiments shown in FIGS. 8A-8C, 9A-9C and 10A-10C can also be applied to the expansion of a collapsible, self-expanding display unit such as that of FIG. 7 with an equivalent result. To that end, the push element 30 in FIGS. 8A, 9A, 10A also incorporates the mentioned connecting configuration 51, 52 for connecting the lateral flaps 15, 25; 16, 26 of the panels 10, 20 by means of elastic bands 55.

Figure 11:
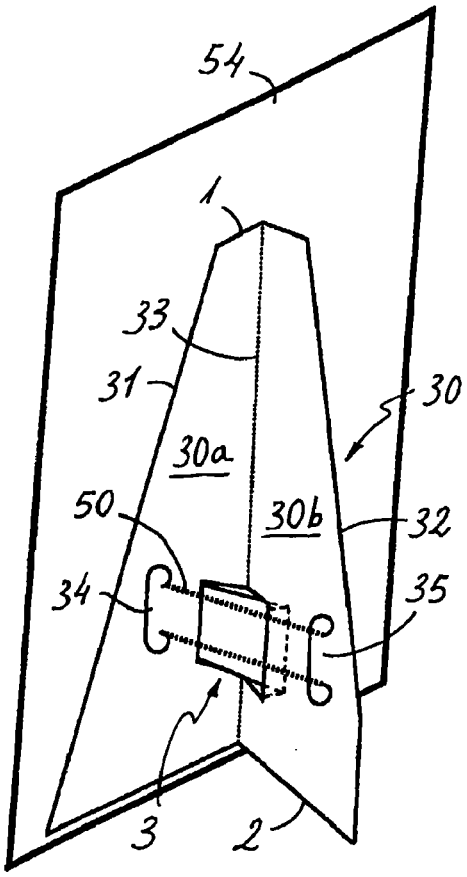
FIG. 11 is a perspective view showing the push element of FIGS. 6A-6C applied to a display unit provided with a flat panel.

FIG. 11 shows an application example of the push element 30 of the present invention as a structural element for supporting a display unit provided with a flat panel 54. The example of FIG. 11 shows the first portion 30*a* of a push element 30 of the type described in relation to FIG. 1A back-to-back and joined to a rear surface of said panel 54, with said main bend line 33 substantially perpendicular to a lower edge of the panel 54. When the structural element adopts its three-dimensional arrangement, the second portion 30*b* of the push element 30, which is not joined to the panel 54, is supported on the ground or other support surface at the same time the mentioned lower edge of the panel 54 does, whereby the panel 54 is supported in an upright position. Preferably, the limiting member 3 is designed to limit the angle formed by the first and second portions 30*a*, 30*b* of the sheet to 90°. Structural elements based on the operating principle of the embodiments shown in FIGS. 8A-8C and 10A-10C, respectively, would also be useful for this application. In the application example of FIG. 11, the pull element 50 is an elastic band having ends respectively engaged to engagement configurations 34, 35 located, respectively, between each of the first and second opposite edges 31, 32 and said main bend line 33 of the push element 30.

Figure 12:
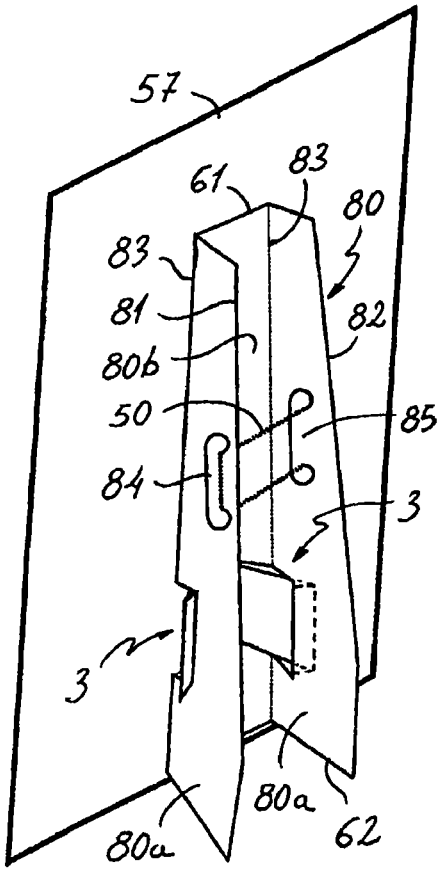
FIG. 12 is a perspective view showing a variant of the push element of FIGS. 6A-6C applied to a display unit provided with a flat panel.

FIG. 12 shows a push element 80, which is a variant of the push element 30 of FIGS. 6A-6C, acting as a structural element applied to the support of a display unit provided with a flat panel 57. Here, the sheet 80 comprises first and second opposite lateral edges 81, 82 and upper and lower opposite edges 61, 62. Two main bend lines 83 extend from one to the other of said upper and lower opposite edges 61, 62, which bend lines divide said sheet 80 into two first end portions 80*a* and a second intermediate portion 80*b*. The structural element here includes two of said limiting members 3, each with their opposite ends respectively connected to one of said end portions 80*a* and to said intermediate portion 80*b* of the sheet 80. The intermediate portion 80*b* of the sheet 80 is arranged back-to-back and joined to a rear surface of said panel 57 of the display unit, with the lower edge 62 of the sheet 80 arranged next to a lower edge of said panel 57. When the sheet 80 is in its three-dimensional arrangement, the mentioned two end portions 80*a* are supported on the ground or other support surface for the purpose of supporting the display unit in an upright position. In this application example, the pull element 50 is an elastic band, and the sheet 80 comprises a pair of engagement configurations 84, 85 located, respectively, between each of the first and second opposite lateral edges 81, 82 and one of said two main bend lines 83 to engage respective ends of the pull element 50. Said engagement configurations 84, 85 could obviously be located next to the first and second opposite lateral edges 81, 82 with an identical result, or engagement configurations could be arranged both in the end portions 80*a* and in the intermediate portion 80*b* for the placement of two corresponding pull elements.

In the application example of FIG. 12, the sheet 80 can be associated to limiting members 3, 93 of the types described in the embodiments of FIGS. 6A-6C, 8A-8C and 10A-10C, respectively. A push element of the present invention including limiting members 3 of the type described in the embodiment of FIGS. 6A-7C is very suitable, since the push element 30, 80 and the limiting members 3 can easily be obtained from the same piece and in the same die-cutting operation with minimal waste of material and without requiring any subsequent handling apart from the placement of the pull members 50.

The flat panels 54 and 57 of the display units of FIGS. 11 and 12 can include transverse bend lines (not shown) to allow zigzag folding of the flat panels 54, 57, in which case the push elements 30, 80 forming part of the structural elements of the present invention could also incorporate transverse bend lines for being folded in accordance therewith.

Figure 13A:
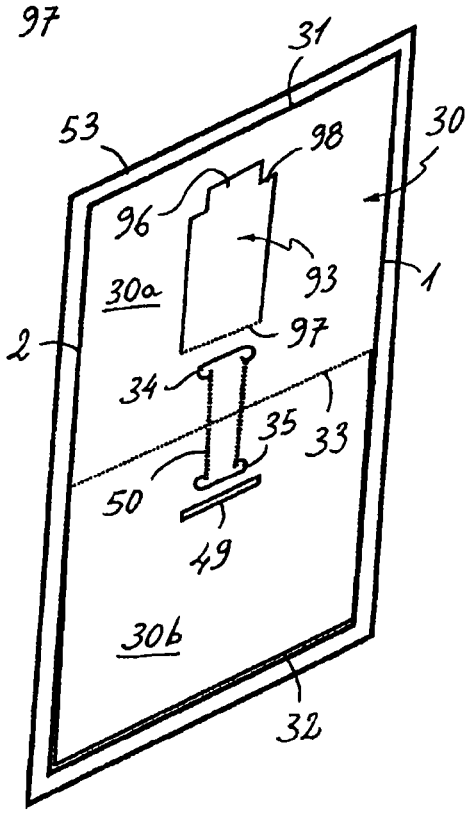
FIGS. 13A and 13B are perspective views showing a variant of the push element of FIGS. 10A-10C applied to a display unit provided with a flat panel.
Figure 13B:
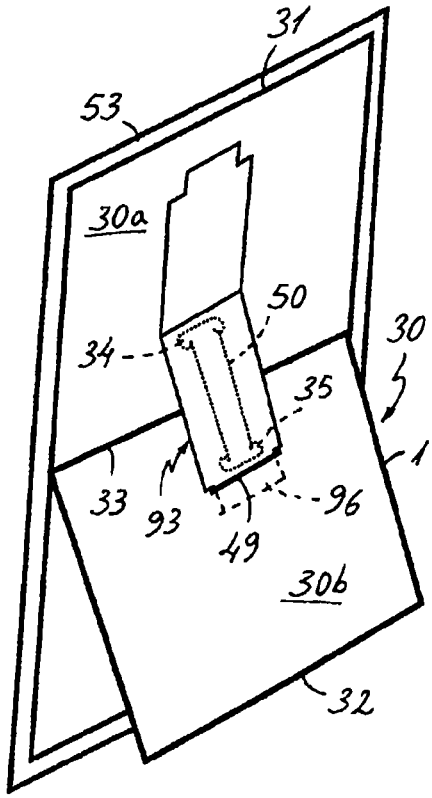

Another application example is described in relation to FIGS. 13A and 13B in which the structural element for supporting a flat panel 53 of a display unit includes a push element 30 similar to the one shown in FIG. 10A, which has the first portion 30*a* arranged back-to-back and joined to a rear surface of the flat panel 53, with said main bend line 33 substantially parallel to a lower edge of said flat panel 53. The limiting member 93 is integrally formed of the same piece as the push element 30 by means of cutting lines demarcating in the first portion 30*a* of the push element 30 the entire contour of the limiting member 93 except the mentioned articulation 97, which is formed by a bend line 97. FIG. 13A shows the limiting member 93 before being assembled. To assembly the limiting member 93, it is enough to bend it along the bend line 97 and insert the sliding portion 96 through the guide cut 49 formed in the second portion 30*b* of the push element 30. When the push element 30 adopts its three-dimensional arrangement shown in FIG. 13B, the stop configurations 98 interfere with the second portion 30*b* of the push element 30, which is fixed at an angle selected so that one of the first opposite edges 32 of the push element 30, corresponding to the second portion 30*b*, is supported on the ground or other support surface at the same time as said lower edge of the panel, for the purpose of supporting the display unit in a upright position.

In the application example of FIGS. 13A and 13B, the engagement configurations 34 and 35 are located respectively between the articulation 97 and the main bend line 33 and between the guide cut 49 and the main bend line 33, to engage the ends of a pull element 50 in the form of an elastic band, which is concealed by the limiting member 93 when it is assembled. This construction is designed for small display units, each intended to be distributed housed inside an envelope with the push element 30 in the flat arrangement and the limiting member 93 assembled, such that when a user takes the display unit out of the envelope, the structural element automatically goes to the convex situation providing a pedestal for the flat panel 53. An application similar to that of FIGS. 13A and 13B can be obtained by using structural elements according to the operating principle of the embodiments described above in relation to FIGS. 6A-6C and 8A-8C.

Figure 14:
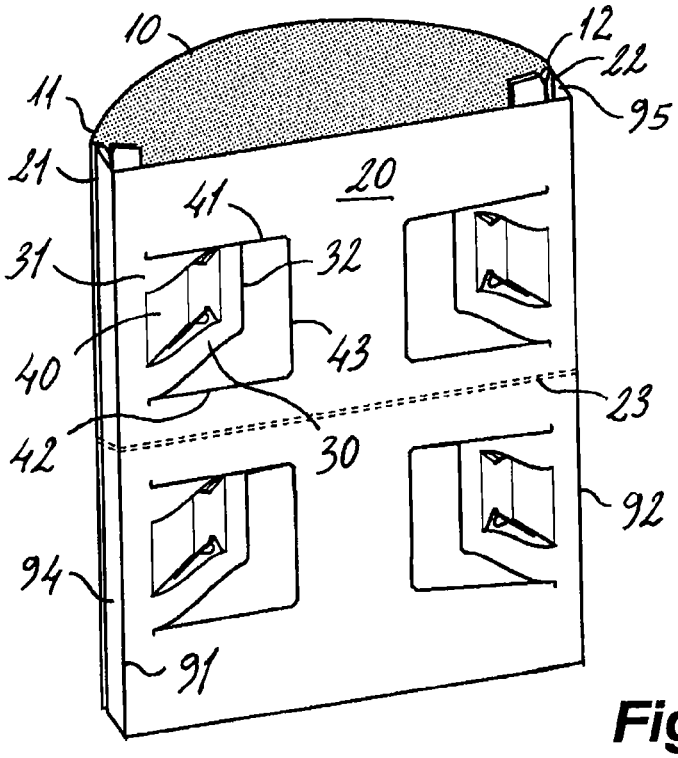
FIG. 14 is a perspective view of another embodiment of the collapsible, self-expanding display unit of the present invention in an expanded arrangement.
Figure 15:
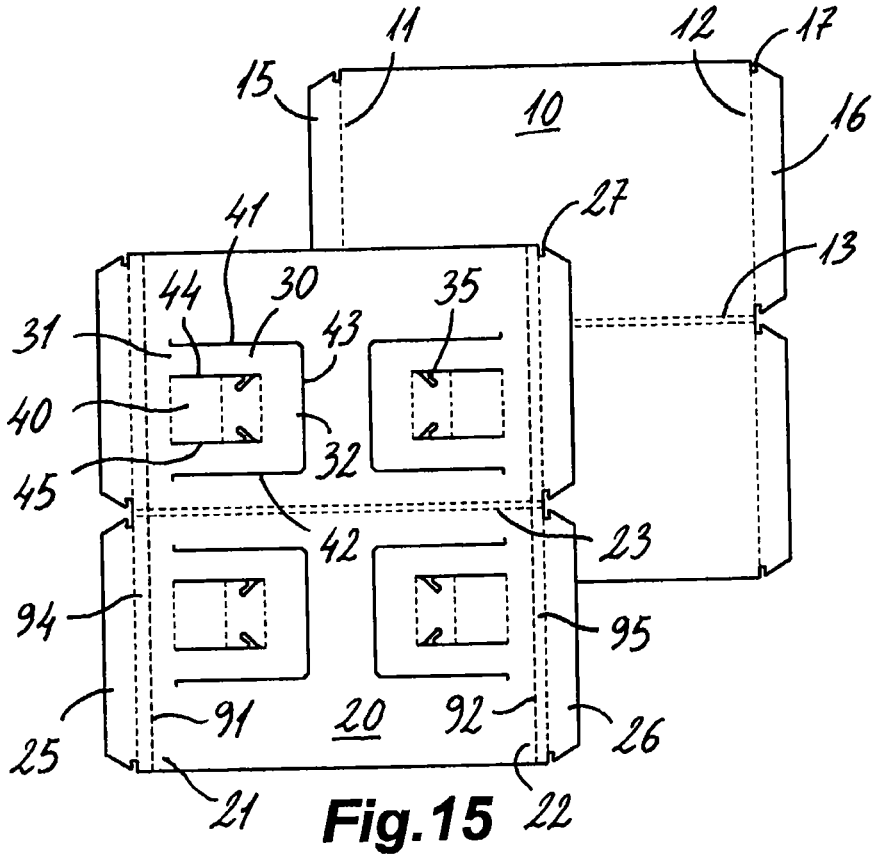
FIG. 15 illustrates the two panels of the display unit of FIG. 14 separated and in a flat arrangement.
Figure 16:
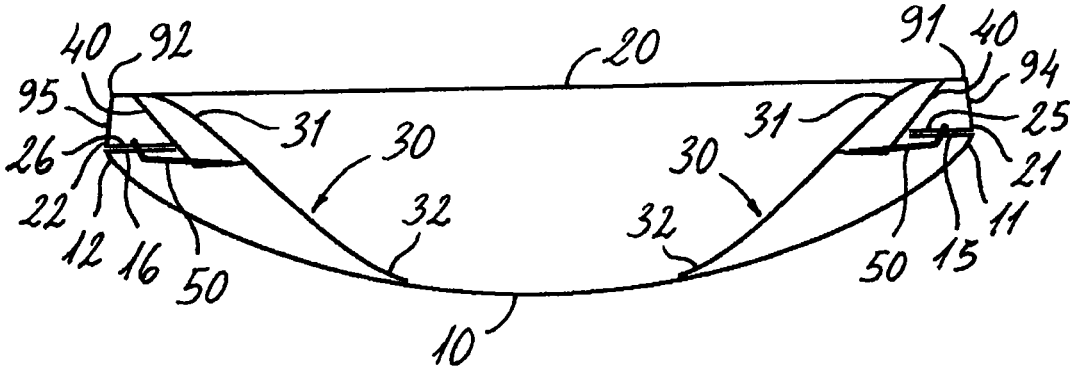
FIG. 16 is a schematic plan view of the display unit of FIG. 14 in an expanded arrangement.

Another embodiment of the collapsible, self-expanding display unit of the present invention is described in FIGS. 14 to 16. In FIG. 14, the display unit comprises first and second panels 10, 20 opposite and joined along their lateral edges 11, 12 and 21, 22. As is best shown in FIG. 15, respective first and second flaps 15, 16 and 25, 26 turned inwards, mutually opposite and joined to one another by means of annular elastic bands 55 in cooperation with respective first and second connecting configurations 17, 27 formed in said flaps extend from the lateral edges 11, 12 and 21, 22 of the two panels 10, 20. One of the panels 20, which is, in the illustrated example, a rear panel 20, comprises vertical bend lines 91, 92 contiguous to the lateral edges 21, 22. A flat portion of the panel 20 remaining substantially flat is defined between said vertical bend lines 91, 92 when the display unit adopts the service position, and longitudinal portions 94, 95 bending towards the other one of the panels 10, i.e. the front panel 10, which adopts a convex arched configuration, are defined between the vertical bend lines 91, 92 and the respective the lateral edges 21, 22 when the display unit is placed in the service position.

In the mentioned flat portion of the panel 20 cuts 41, 42, 43 are formed defining push elements 30. More specifically, for every one of the mentioned push elements 30, said cuts 41, 42, 43 define upper and lower edges, as well as a free second edge 32, whereas the push element 30 is joined to the flat portion of the panel 20 along a first edge 31 in an area contiguous to one of the lateral edges 11, 12 of the panel 20. The push element 30 in turn includes cuts 44, 45 substantially perpendicular to the first and second lateral edges 21, 22 of the rear panel 20 and bend lines substantially parallel to the first and second lateral edges 21, 22 of the rear panel 20 and extending from one to the other of said cuts 44, 45 to define a limiting member 40 inside the push element 30. This limiting member 40 works similarly to the limiting member 3 in the embodiment shown in FIGS. 6A-6C works. Here, the limiting member 40 includes the first connecting configurations 35 in which a pull element 50 (FIG. 16) engages, said pull element being, for example, in the form of an annular elastic band joined at its other end to the corresponding mutually opposite and joined flaps 15, 25; 16, 26 of the panels 10, 20. Advantageously, the same annular elastic band used to join the flaps 15, 25; 16, 26 to one another can be used in replacement of the mentioned pull element 50. Due to the force exerted by the pull elements 50, the push elements 30 are rotated, curved or bent while at the same time the limiting members 40 move until the limiting members 40 make contact with at least one of the flaps 15, 16, 25, 26 of the corresponding lateral edge 11, 12, 21, 22 of at least one of the panels 10, 20 (FIG. 16).

As shown in FIGS. 14 and 15, the upper and lower cuts 41, 42 have respective ends close to and substantially at the same distance from the corresponding vertical bend line 61, 62, therefore the push element 30 has the tendency to rotate, curve or bend with respect to an axis substantially parallel to the vertical bend lines 61, 62 or first and second lateral edges 21, 22 of the rear panel 20 such that the second free end 32 of each push element 30 is pushed against the front panel 10. In the embodiment shown in FIGS. 14 to 16, the push element 30 is deformed, curving in the shape of an S. However, one or more bend lines (not shown) parallel to the lateral edges 21, 22 of the rear panel 20 could be included in the push element 30 so as to force the push element to rotate or bend along such bend lines with an equivalent result.

Like in the display unit described above in relation to FIG. 2, in the embodiment of FIGS. 14 to 16, the two panels 10, 20 comprise respective transverse bend lines 13, 23 extending from the first lateral edge 11, 21 to the second lateral edge 12, 22 dividing the respective panels 10, 20 into several mutually opposite portions 14, 24. In this way, the display unit is adapted to be folded by bending it along said transverse bend lines 13, 23 from said collapsed situation to a folded position in which it adopts a flat configuration, in which said portions 14, 24 are mutually overlapping. Here also, at least one first push element 30 is arranged next to the first edges 11, 21 and at least one second push element 30 is arranged next to the second edges 12, 22 for every pair of mutually opposite portions 14, 24 of the first and second panels 10, 20.

Figure 17:
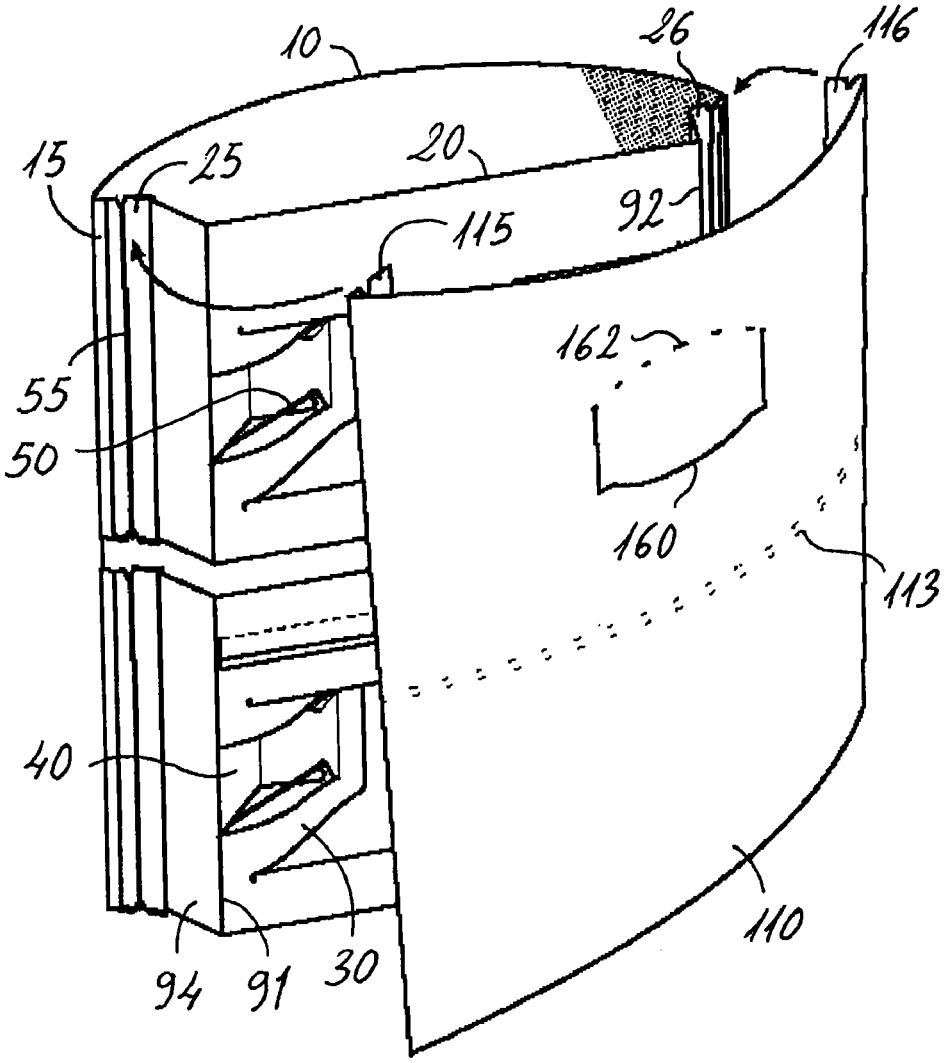
FIG. 17 is a perspective view of yet another embodiment of the collapsible, self-expanding display unit of the present invention in an expanded arrangement, and with a partially withdrawn additional panel.
Figure 18:
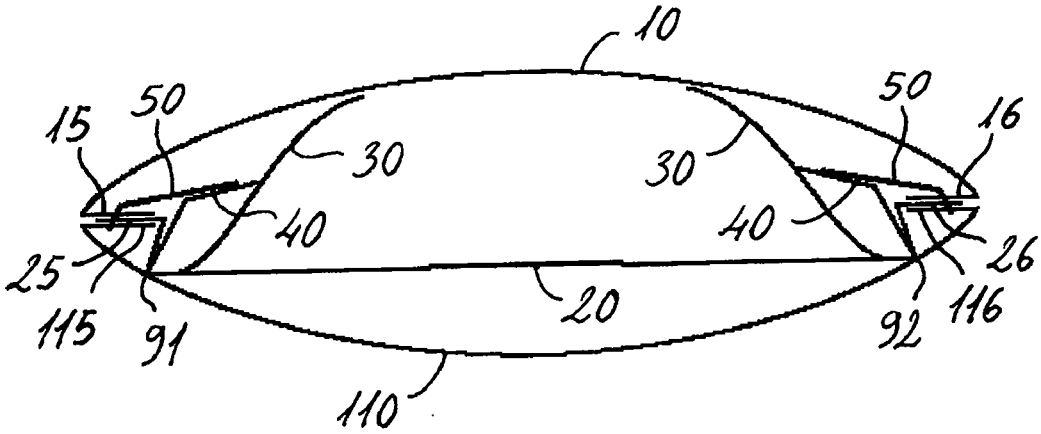
FIG. 18 is a schematic plan view of the display unit of FIG. 17 in an expanded arrangement.

FIGS. 17 and 18 show another embodiment of the display unit of the present invention which is similar to the described above in relation to FIGS. 14 to 16, with the difference here being that the display unit comprises an additional panel 110 opposite to the panel 20 having the push elements 30 formed, which here is an inner panel 20. For it support, this additional panel 110 comprises next to its lateral edges corresponding first and second flaps 115, 116 turned inwards. In this case, the inner panel 20 having the push elements 30 formed has its first and second flaps 25, 26 turned outwards and interposed between the first flaps 15, 115 and second flaps 16, 116 of the other panel 10 and of the additional panel 110, respectively, as is best shown in FIG. 18. With this construction, when the display unit adopts the service position, the first panel 10 is pushed towards its convex configuration by the push elements 30 whereas the additional panel 110 is pushed towards a convex configuration, in an opposite direction to the first panel 10, by edges coinciding with said vertical bend lines 91, 92 of the inner panel 20.

Figure 19:
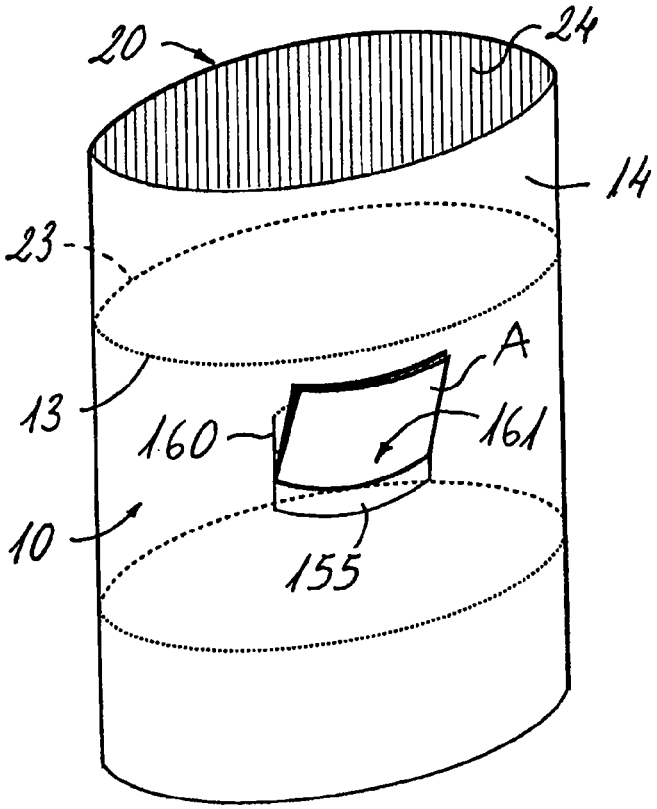
FIG. 19 is a perspective view of a display unit according to one of the embodiments of the present invention, including a folder associated to an opening of a first panel.
Figure 19A:
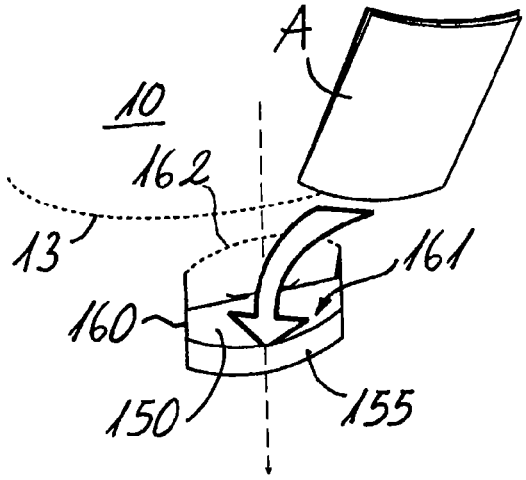
FIG. 19*a* is an illustrative diagram of the placement of several flattened items in the folder of the display unit of FIG. 19.
Figure 20:
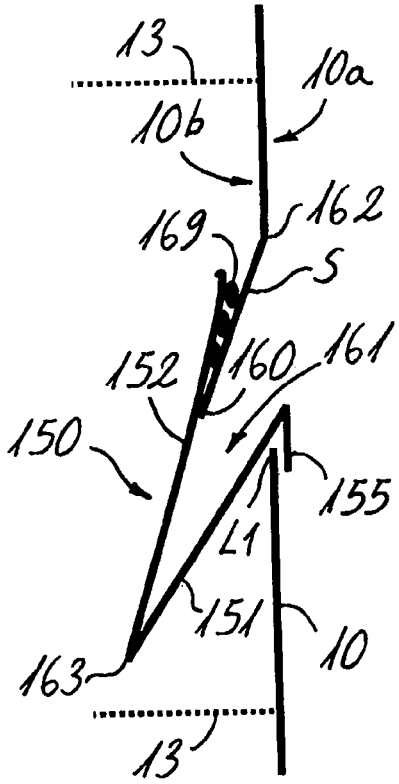
FIG. 20 is a schematic cross-section view of the first panel and the folder of the display unit of FIG. 19.

FIG. 19 shows a pocket-like folder applied to a collapsible, self-expanding display unit similar to the one described above in relation to FIGS. 1 to 4, or similar to any other embodiment of the present invention. A first panel 10, of the two panels 10, 20 forming the display unit, has an outer face 10*a* intended to be displayed, and an opposite inner face 10*b*, intended to be concealed (FIG. 20). An essential feature of the present invention is that the first panel 10 comprises a cut 160 with a transverse cut section L1 (FIG. 23) defining an opening 161 accessible from said outer face 10*a* of the first panel 10. The mentioned opening is suitable for the passage of items A, generally flat items, such as sheets of paper. As is best shown in FIG. 20, a laminar element 150 is arranged next to said inner face 10*b* of the first panel 10 and associated to said cut 160. This laminar element 150 (best shown in FIGS. 21 and 22) comprises first and second portions 151, 152 opposite and joined at their lower ends. Once installed in the display unit (FIG. 20), said first portion 151 of the laminar element is adjacent to the inner face of the first panel 10 and said second portion 152 is opposite to the first portion 151. Generally, an upper end of the first portion 151 of the laminar element 150 is attached to the first panel 10 at a lower edge or under said transverse cut section L1 of the cut 160, and an upper end of said second portion 152 of the laminar element 150 is attached to or supported on the first panel 10 at an upper edge or above the transverse cut section L1 of the cut 160. In this way, the laminar element 150 forms a folder in the inner part 10*b* of the first panel 10, which has an inlet communicated with said opening 161 and is suitable for housing said items A at least in part, which items, as shown in FIG. 19*a*, can be inserted or taken out from the outer face 10*a* of the first panel 10 through the opening 161 defined by the cut 160.

It will obviously be understood that the application of the folder formed by the laminar element 150 is not limited to a display unit provided with two panels, one of said panels being a panel 10 adopting a dished configuration in the service position, rather it is generalized for any type of display unit comprising at least one first laminar panel 10 that can be supported in an upright service position, whether in a flat or dished configuration.

Figure 21:
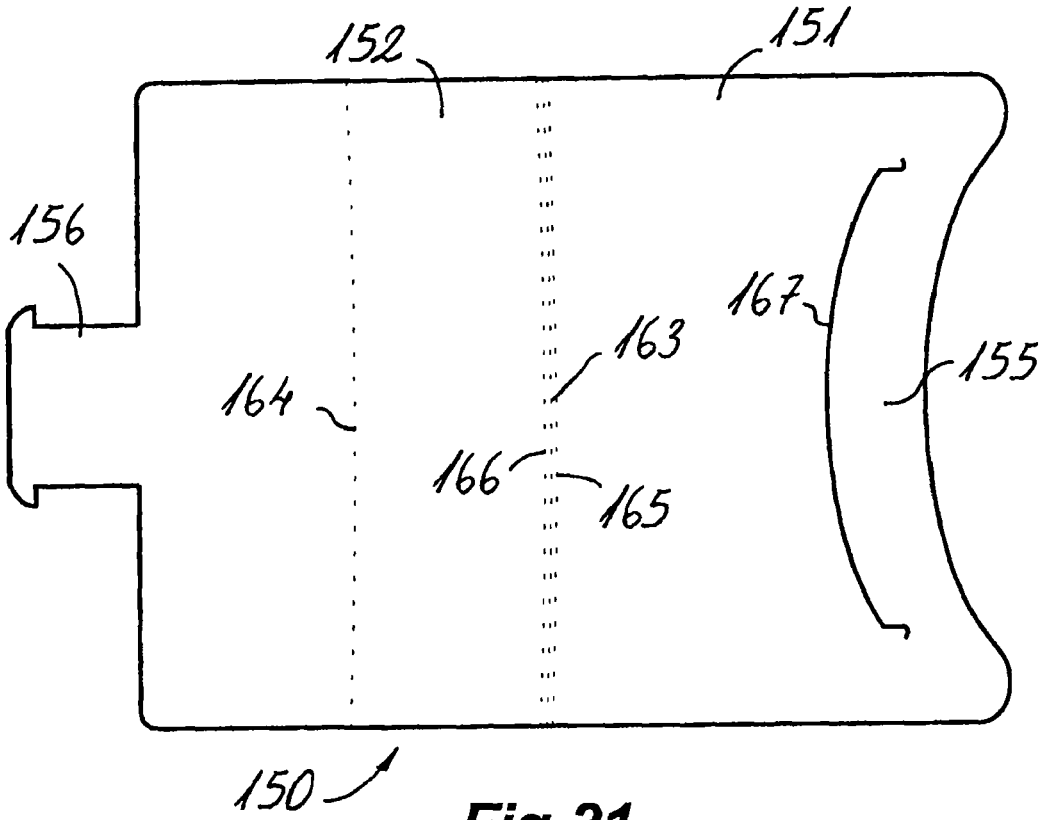
FIG. 21 is a plan view of an embodiment of a laminar element adapted to form the folder of the display unit of FIG. 19.
Figure 22:
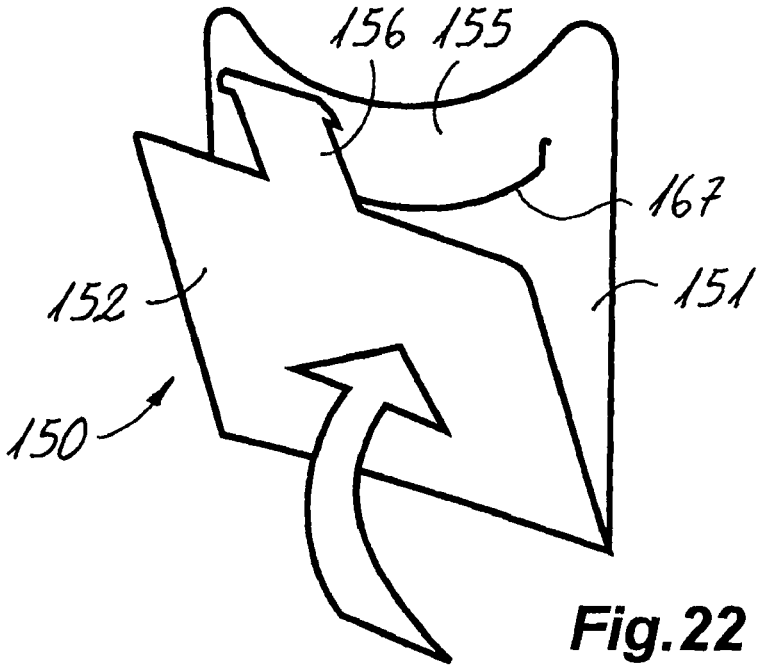
FIG. 22 is a view of the laminar element of FIG. 3 once it is bent.

In the laminar element 150 shown in FIGS. 21 and 22, the first and second portions 151, 152 are from the same piece including a transverse bend line 163 along which it can be bent to adopt the configuration shown in FIG. 22. This laminar element 150 preferably includes at least one additional transverse bend line 164 in a middle part of the second portion 152, and one or more additional transverse bend lines 165, 166 adjacent and parallel to said transverse bend line 163 to provide a deeper folder and allowing it to house a greater volume of items A. Alternatively, according to an embodiment not shown, the first and second portions 151, 152 of the laminar element 150 are of different pieces joined at their lower ends in the place corresponding to the mentioned transverse bend line 163.

Figure 23:
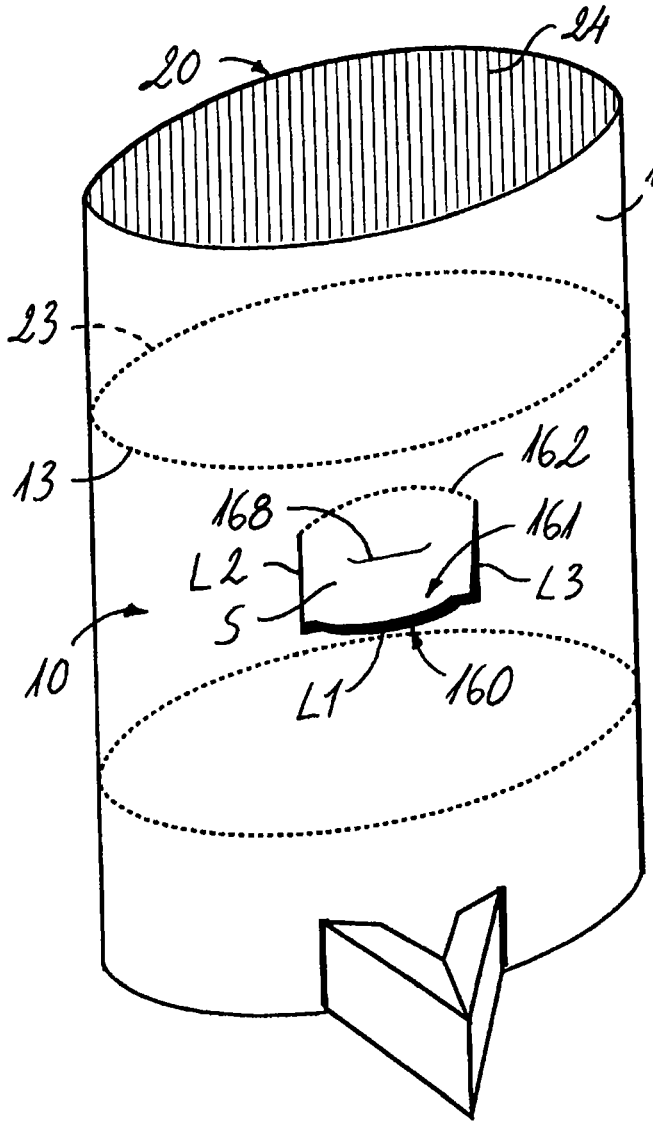
FIG. 23 is a perspective view illustrating the installation of the laminar element of FIG. 21 forming the folder in another embodiment of the display unit of the present invention.
Figure 23A:
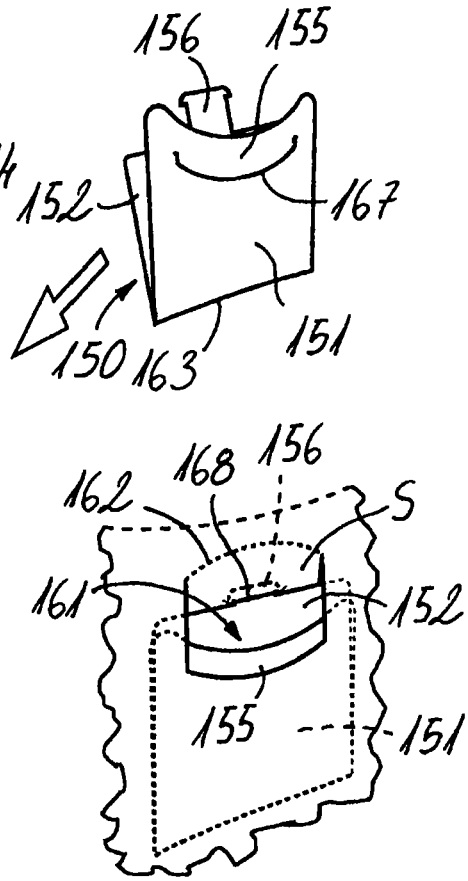
FIG. 23*a* is a detail view showing part of the display unit of FIG. 23 with the folder installed.

In an embodiment of the folder shown in FIG. 22, the cut 160 existing in the first panel 10 of the display unit comprises, in addition to the mentioned transverse cut section L1, two other cut sections L2, L3 connected with the ends of said transverse cut section L1. These two other cut sections L2, L3 extend upwardly, defining a U-shaped cut 160 together with transverse cut section L1. A flap S is defined between said three cut sections L1, L2, L3, said flap being bent slightly towards an inner part with respect to the rest of the first panel 10 along a bend line 162. FIG. 23 also shows a laminar element 150 according to the embodiment of FIGS. 21 and 22 before being installed in the first panel 10 of the display unit. In this case, the first portion 151 of the laminar element 150 is attached to the first panel 10 by means of a first fixing configuration comprising at least one slit 167 located at a distance from the upper end of the first portion 151 of the laminar element 150. This slit 167 defines a lip 155 that can be attached to the lower edge of the transverse cut section L1 of the cut 160, as shown in FIGS. 20 and 23*a*. The upper end of the second portion 152 of the laminar element 150 is attached to the first panel 10 by means of a second fixing configuration comprising at least one engagement member 156 extending from the upper edge of the second portion 152 of the laminar element 150, adapted to be introduced an engaged in at least one slit 168 defined in said flap S, as shown in FIG. 23, or alternatively in an area of the panel 10 above the upper edge of the cut 160.

Note that in the construction of FIG. 20, whereas the attachment of the upper end of the first portion 151 of the laminar element 150 to the transverse cut section L1 of the cut 160 is done by means of the lip 155 in a manner similar to that described in relation to FIGS. 21, 22 and 23, the second portion 152 of the laminar element 150 is alternatively joined to the first panel 10 by means of an adhesive 169 arranged between an area close to the upper end of the second portion 152 of the laminar element 150 and an area of the inner face of said flap S. Obviously, and as an alternative not shown, the first portion 151 of the laminar element 150 may also be attached to the first panel 10 by means of an adhesive arranged, for example, between an area close to the upper end of the first portion 151 of the laminar element 150 and an area of the first panel 10 under the lower edge of the cut 160.

Figure 24:
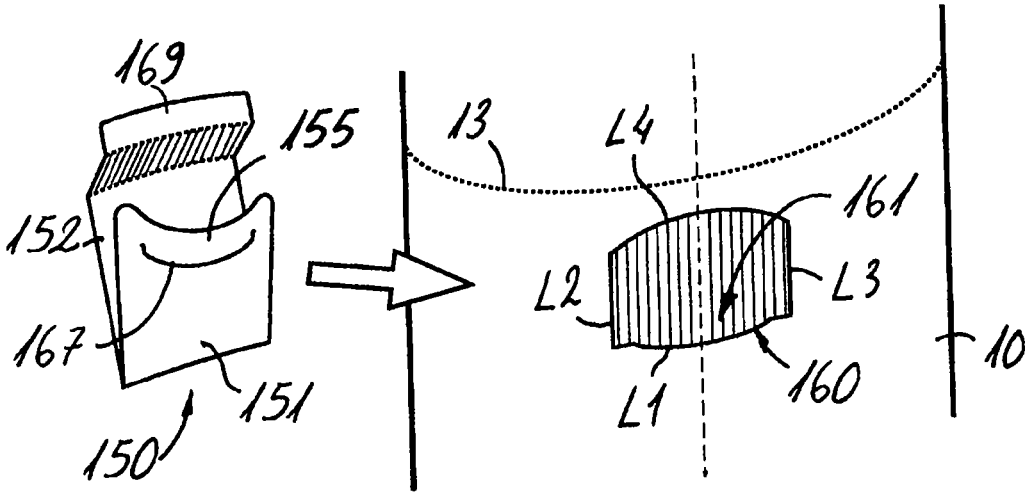
FIG. 24 is a partial perspective view showing another embodiment of the display unit of the present invention before installing the laminar element forming the folder.
Figure 25:
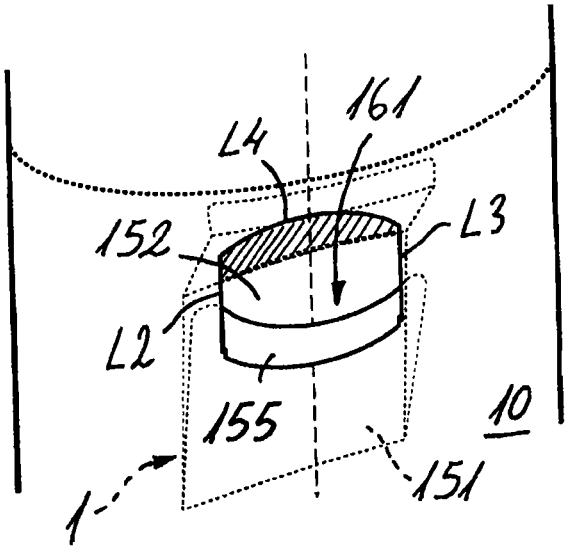
FIG. 25 is a partial perspective view of the display unit of FIG. 24 with the folder installed.
Figure 26:
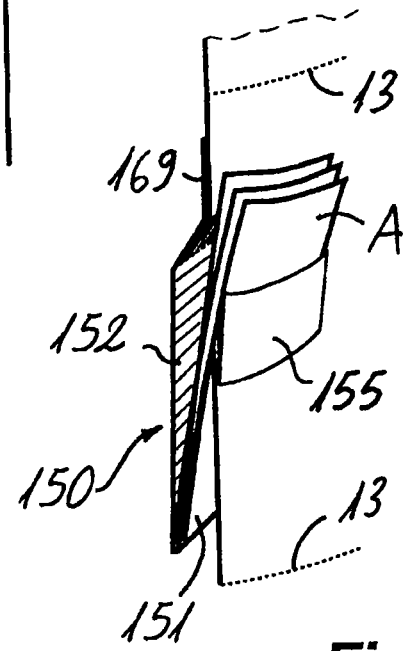
FIG. 26 is a partial sectioned perspective view showing the folder of the display unit of FIG. 24 containing sheets of paper.

FIG. 24 partially shows the first panel 10 of the display unit where the cut 160 is located. In this embodiment, the cut 160 comprises, in addition to the three cut sections L1, L2, L3 described above in relation to FIG. 23, a fourth cut section L4 connected at its ends with said two other cut sections L2, L3 forming a closed cutting line demarcating said opening 161. In other words, the material of the panel 10 corresponding to the opening 161 has been eliminated by the cut 160. FIG. 24 also shows a laminar element 150 before being installed in the first panel 10. Here, the second portion 152 of the laminar element 150 has a length from its lower end to its upper end that is greater than the first portion 151. As a result, when the laminar element 150 is installed, the second portion 152 completely covers the opening 161, as shown in FIGS. 25 and 26. In this embodiment, the attachment of the upper end of the first portion 151 of the laminar element 150 to the transverse cut section L1 of the cut 160 is carried out by means of the lip 155, in a manner similar to that described in relation to FIGS. 21, 22 and 23, whereas the second portion 152 of the laminar element 150 is joined to the first panel 10 by means of an adhesive 169 arranged between an area close to the upper end of the second portion 152 of the laminar element 150 and an area of the first panel 10 above said upper edge of said cut 160, i.e. above the fourth section L4 of the cut 160.

Figure 27:
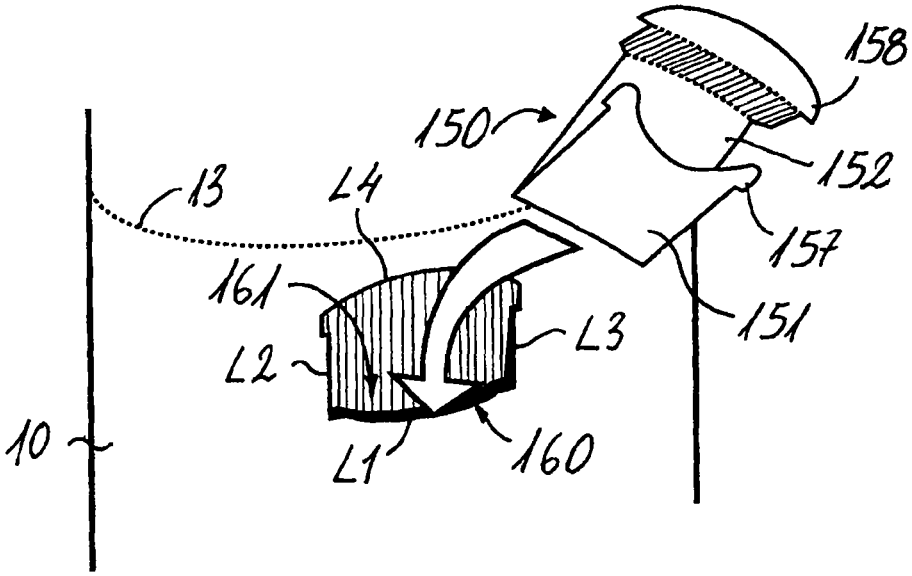
FIG. 27 is a partial perspective view showing another embodiment of the display unit of the present invention before installing the laminar element forming the folder.
Figure 28:
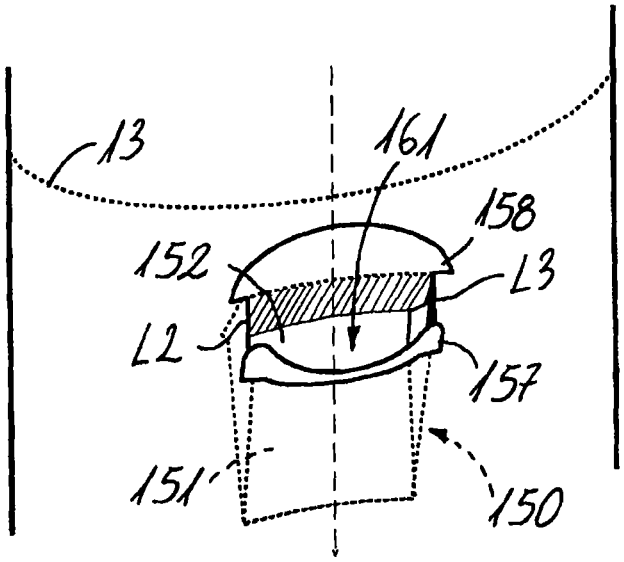
FIG. 28 is a partial perspective view of the display unit of FIG. 27 with the folder installed.
Figure 29:
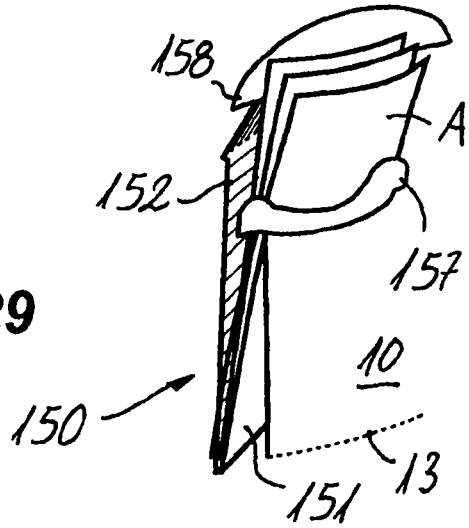
FIG. 29 is a partial sectioned perspective view showing the folder of the display unit of FIG. 27 containing sheets of paper.

In relation to FIGS. 27 to 29, another embodiment of the folder is described in which the cut 160 includes four cut sections L1, L2, L3, L4 demarcating an opening 161 free of material in the first panel 10, in a manner similar to that described above in relation to FIG. 24. FIG. 27 furthermore shows a laminar element 150 adapted to be installed in the opening 161 of the first panel 10. In this embodiment, both the first portion 151 and the second portion 152 of the laminar element 150 are attached to the first panel 10 by means of respective fixing configurations. Thus, flaps 157 adapted to engage in the convergence of the lateral cut sections L2 and L3 with the transverse cut section L1 project from the upper end of the first portion 151. Similarly, flaps 158 adapted to engage in the convergence of the lateral cut sections L2 and L3 with the fourth cut section L4 laterally project from the upper end of the second portion 152. In this way, the folder formed by the laminar element 150 is attached to the first panel 10 without needing to use adhesive, as shown in FIGS. 28 and 29. FIG. 29 furthermore shows sheets of paper I inserted through the opening 161 and housed in the folder formed by the laminar element 150. In a particular application, the depth of the folder formed by the laminar element 150 is less than the length of said sheets of paper I so that the sheets of paper I project therefrom through the opening 161 and are available to the public. However, the present invention is not limited to this application and the folder can completely house the sheets of paper or it may be adapted to house other items such as, for example, brochures, coupons, letters, pens, or the like, candies, promotional objects, among others.

In all the embodiments of the folder, the cut 160 and the folder formed by the laminar element 150 associated thereto are advantageously located in one of the mentioned portions 14 of the first panel 10 between two transverse bend lines 13, in such a position that when the display unit adopts the folded position, the first and second portions 151, 152 of the laminar element 150 forming the folder are not bent.

In the embodiments of the folder of FIGS. 19 to 26, the lip 155 of the laminar element 150 is displayed, flush with the front face 10*a* of the first panel 10, which generally includes information in the form of text, drawings, photographs, etc. Therefore it is appropriate for the lip 155 to be printed according to the general information of the first panel, and this can be done by printing an outer face of the entire laminar element, including the lip 155. The upper support edge of this lip 155 is configured in an arch and, as can be seen in the figures, this means that the brochures can be arched and joined without being bents, having a tilted orientation. The upper edge of the lip 155 is curved with the central part downwards, which aids in keeping the laminar elements arranged in the folder or box upright.

Figure 30:
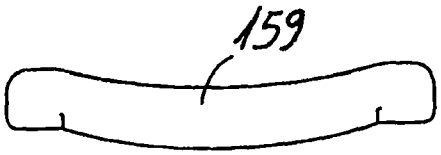
FIG. 30 is a plan view of a lip of a laminar material.
Figure 31:
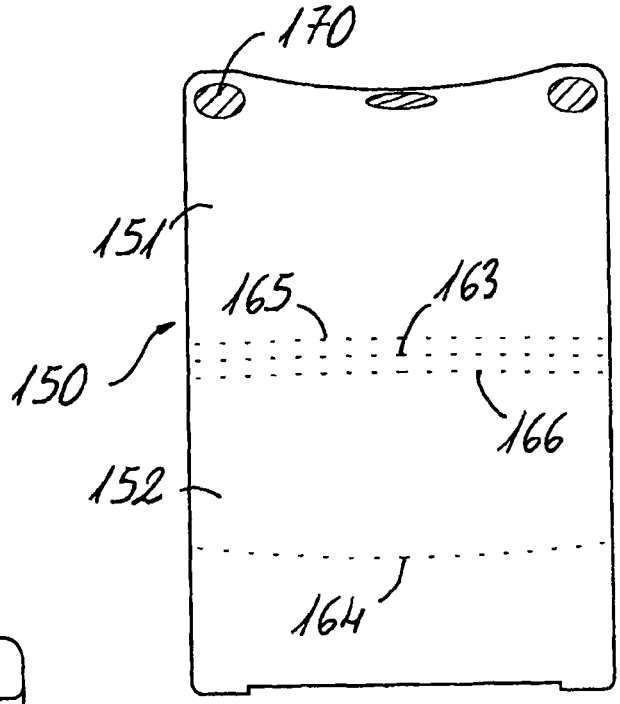
FIG. 31 is a plan view of a piece of laminar material adapted to be joined with the lip of FIG. 30 to form another embodiment of the laminar element forming the folder of the display unit of the present invention.
Figure 32:
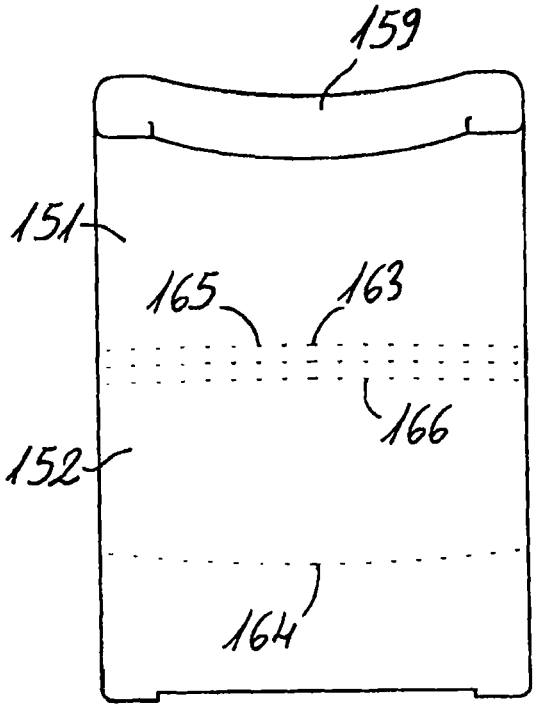
FIG. 32 is a plan view of the laminar element obtained from the joining of the lip and the piece of FIGS. 30 and 31.

FIGS. 30 to 32 show an alternative embodiment of the folder which allows including printed information in the displayed lip of the laminar element in a more cost-effective manner than printing the entire laminar element. Therefore, FIG. 30 shows a lip 159 made from a piece of laminar material printed with the desired information. This piece forming the lip 159 is prepared to be glued by means of an adhesive 170 (FIG. 31) next to the upper end of the first portion 151 of the laminar element 150, with the result shown in FIG. 32. In this way, the lip 159 can be engaged in the lower edge of the transverse cut section L1 of the cut 160 demarcating the opening 161 of the first panel 10, and carries out the functions of the first fixing configuration formed by the lip 155 described above in relation to FIGS. 21 and 22, with the difference here being that only the lip 159 is printed. Otherwise, as shown in FIG. 32, the obtained laminar element 150 includes the transverse bend line 163 and optionally the additional bend lines 164, 165 and 166, like in the previous embodiments.

Figure 33:
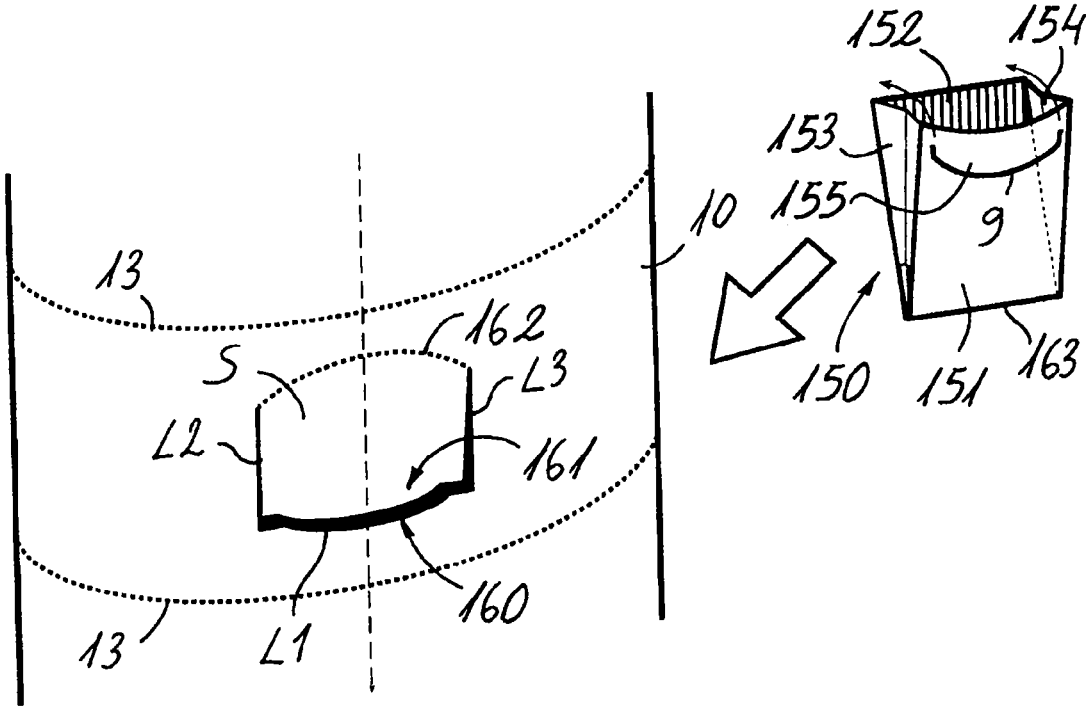
FIG. 33 is a partial perspective view showing another embodiment of the display unit of the present invention before installing the laminar element forming the folder.
Figure 34:
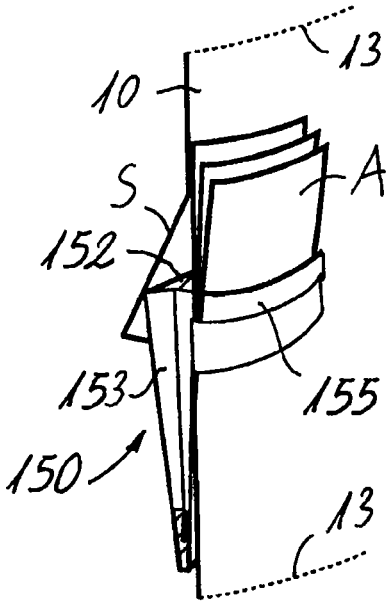
FIG. 34 is a partial sectioned perspective view showing the folder of the display unit of FIG. 33 containing sheets of paper.

FIG. 33 shows yet another embodiment of the present invention in which the first panel 10 includes a cut 160 defining an opening 161. The cut 160 comprises three cut sections L1, L2, L3 arranged in the shape of a U, defining a flap S slightly bent along a bend line 162, in a manner similar to that described above in relation to FIG. 23. FIG. 33 further shows a laminar element 150 before being installed in the opening 161 of the first panel 10. In this case, the folder formed by the laminar element 150 comprises, in addition to the first and second portions 151, 152, two folding lateral portions 153, 154 laterally joining the first and second portions 151, 152 limiting their angle of opening when they rotate with respect to their joined lower ends, for example, in the transverse bend line 163. Once the folder is installed in the opening 161, as shown in the detail of FIG. 34, the lip 155 is engaged in the edge of the transverse cut section L1 of the cut 160 whereas the upper end of the second portion 152 of the laminar element 150 is simply supported on an outer face of the flap S. This is possible as a result of the fact that the angle of opening of the folder is limited by the lateral portions 153 and 154.

In the embodiments of the folder shown and described, in the service position the first panel 10 has an outwardly dished convex three-dimensional configuration. For this reason, the folder formed by the laminar element 150 and the opening 161 are adapted to accommodate to this dished configuration of the first panel 10 when the display unit goes from a collapsed situation to the service position. To that end, the bend line 162 along which the flap S is bent is curved, with its middle part upwards and the transverse cut section L1 of the cut 160 is curved with its middle part downwards. The transverse bend line 163 of the laminar element 150, like the adjacent bend lines 165, 166, when there are any, is curved, with its middle part towards the first portion 151, and the bend line 164 located in the second portion 152 of the laminar element 150 is curved with its middle part towards the upper end of the second portion 152. Furthermore, the edge of the upper end of the first portion 151 of the laminar element 150 and optionally the slit 167 are curved with their middle part downwards.

Figure 35:
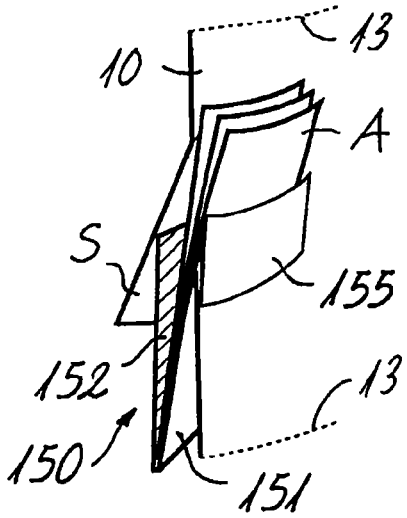
FIG. 35 is a partial sectioned perspective view showing another embodiment of the folder of the display unit of the present invention containing sheets of paper.

The fact that the bend line 162 along which the flap S is bent is slightly curved has the additional advantage of limiting up to a certain point, the ability of the flap S to bend inwards along the bend line O. FIG. 35 shows an additional embodiment in which, in the service position, the first portion 151 of the laminar element 150 forming the folder is attached to the transverse cut section L1 of the cut 160 whereas the second portion 152 is simply supported against the outer face of the flap S of the first panel 10, which withstands the stress due to its limited bending ability.

The fact that the edge of the upper end of the first portion 151 of the laminar element 150 is curved with its middle part downwards, in combination with the dished configuration of the first panel 10, has the additional advantage of giving the sheets of paper or brochures housed in the folder projecting from the opening 161 (FIGS. 26, 29, 35), and which are supported in said curved upper edge, a slightly arched configuration aiding in keeping them upright.

FIGS. 36-39 show another embodiment of the invention, wherein one of the panels 10 comprises one cut 160 defining an opening 161 accessible from an outer face 10*a* of the panel 10 and suitable for the passage of items A. As better shown in FIG. 38, said cut 160 comprises one upper transverse cut section L1 and two side cut sections L2, L3 which extend downwards from the ends of the transverse cut section L1 in an inverted U shape which defines a flap S connected to the panel 10 by a lower bend line 262. The flap S can be bent outwards and towards an upper part of the display unit along said lower bend line 262.

Figure 36:
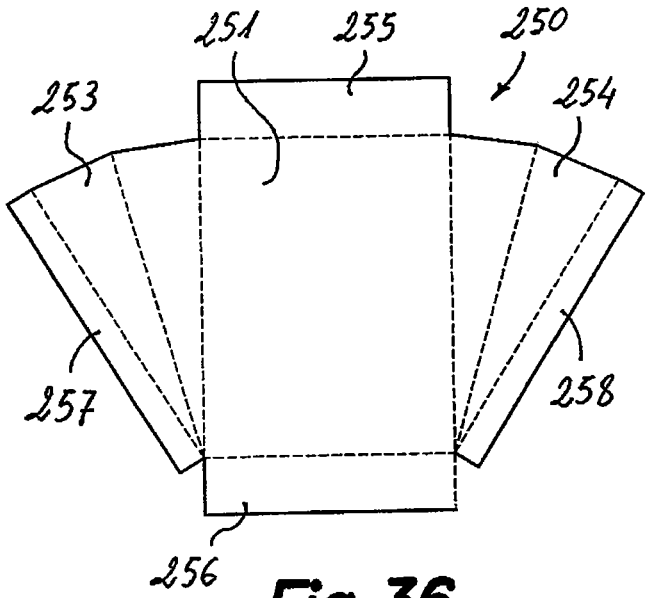
FIG. 36 is a plan view of an embodiment of a laminar element adapted to form the folder of the display unit of FIG. 39.
Figure 37:
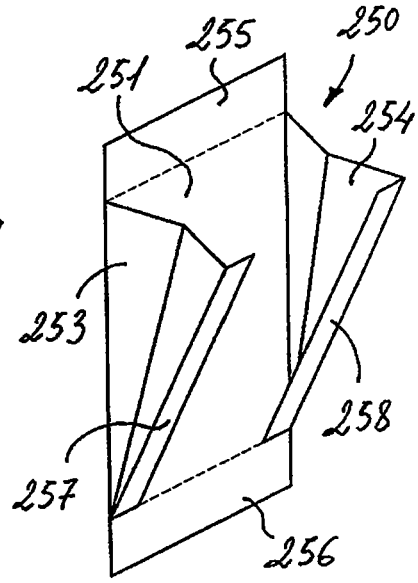
FIG. 37 is a perspective view of the laminar element of FIG. 36 folded along fold lines.
Figure 38:
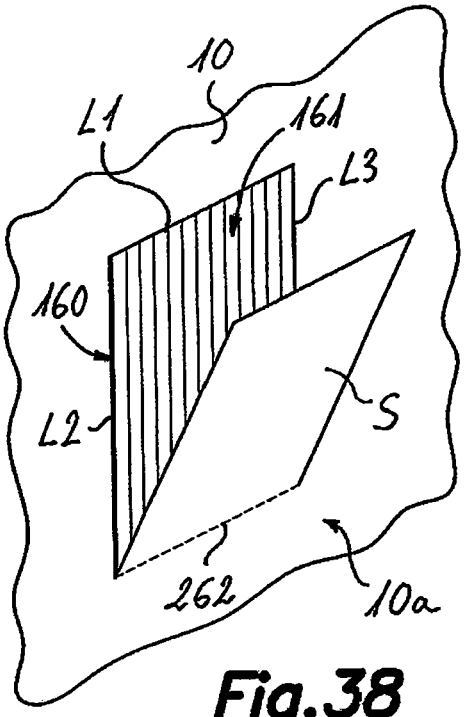
FIG. 38 is a partial perspective view of one of the panels forming the collapsible, self-expanding display unit with a cut defining an opening and a flap.
Figure 39:
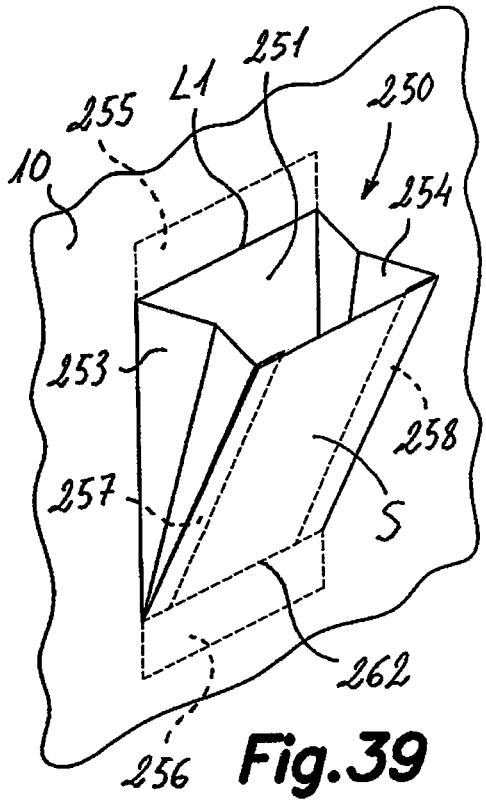
FIG. 39 is a partial perspective view of the collapsible, self-expanding display unit with a folder formed by the laminar element of FIGS. 36 and 37 assembled to the opening and the flap of the panel of FIG. 38.

A laminar element 250 best shown in FIGS. 36 and 37 comprises a back portion 251, two folding lateral portions 253, 254 extending from opposite side edges of said back portion 251 and including longitudinal fold lines, upper and lower fixation flaps 255, 256 extending from upper and lower edges of the back portion 251 and front fixation flaps 257, 258 extending from front edges of folding lateral portions 253, 254. All the portions of the laminar element 250 are connected to one another by scored folding lines which allow the laminar element 250 to be folded as shown in FIG. 37.

Once the laminar element 250 is conveniently folded, the upper and lower fixation flaps 255, 256 thereof are attached, for example by adhesive, to an inner side of the panel 10 above the upper transverse cut section L1 and below the lower bend line 262 respectively, and the front fixation flaps 257, 258 are attached, for example by adhesive, to the flap S at or near the side edges thereof. This way, the back portion 251 of the laminar element 250 and the flap S of the panel 10 form a folder with an inlet communicated with said opening 161 and suitable for housing, at least in part, said items A, said folder being laterally closer by folding lateral portions 253, 254. Furthermore, the folder can be collapsed by folding the folding lateral portions 253, 254 when the display unit is folded to the flat configuration.

Alternatively, other retention members such as flexible ribbon portions can be provided for connecting the back portion 251 of the laminar element 250 to the flap S instead of the folding lateral portions 253, 254.

The laminar element forming the pocket-like folder according to the invention or at least part thereof can be a flexible element bent to form a pouch.

Although the invention is illustrated and described herein with reference to specific embodiments, the invention is not intended to be limited to the details shown. Rather, various modifications may be made in the details within the scope and range of equivalents of the claims and without departing from the invention.

The invention claimed is:

1. A collapsible, self-expanding display unit comprising at least two opposite panels joined at their respective lateral edges and, which in a collapsed situation adopt a flat configuration, and in a service position adopt a convex configuration able to stand upright, and expansion means including at least one pull element to automatically expand said panels from said collapsed situation to said service position, wherein at least one of the panels comprises at least one cut defining an opening suitable for the passage of items and accessible from an outer face of the panel, said cut defining a lower edge and an upper edge, at least one laminar element being included comprising at least first and second portions mutually opposite and joined to one another at their lower edges, said laminar element being arranged next to an inner face of the panel with an upper end of said first portion attached to or supported on the first panel at said lower edge of the cut, or under same, and an upper end of said second portion attached to or supported on the first panel at said upper edge of the cut, or above same, such that the portions of the laminar element form a folder with an inlet communicated with said opening and suitable for housing at least a portion of said item.

2. A display unit according to claim 1, wherein the cut comprises at least one transverse cut section defining said lower edge and said upper edge.

3. A display unit according to claim 2, wherein the cut comprises at least two other cut sections connected with the transverse cut section and extending upwards from the ends of the transverse cut section in a U shape, a flap bent towards an inner part of the display unit in relation to the rest of the first panel along a bend line being defined between said three cut sections.

4. A display unit according to claim 2, wherein said first portion of the laminar element is attached to the first panel by means of a first fixing configuration comprising a slit located at a distance from the upper end of the first portion of the laminar element, said slit defining a lip suitable for being engaged in the lower edge of the transverse cut section of the cut.

5. A display unit according to claim 3, wherein the second portion of the laminar element is joined to the first panel by an adhesive arranged between an area close to the upper end of the second portion of the laminar element and an area of said flap.

6. A display unit according to claim 3, wherein the second portion of the laminar element is joined to the first panel by a second fixing configuration comprising at least one engagement member extending from an upper edge of the second portion of the laminar element, adapted to be introduced an engaged in at least one slit defined in said flap or in an area of the panel above the flap.

7. A display unit according to claim 1, wherein the cut comprises a first transverse cut section, second and third cut sections extending upwards from the ends of the first transverse cut section in a U shape, and a fourth transverse cut section connected at its ends with said second and third cut sections, said first, second, third and fourth cut sections demarcating said opening, and the second portion of the laminar element is joined to the first panel by means of an adhesive arranged between an area close to the upper end of the second portion of the laminar element and an area of the first panel above said fourth transverse cut section.

8. A display unit according to claim 3, wherein said laminar element includes two folding lateral portions laterally joining the first and second portions to limit their angle of opening when they are rotated about their joined lower edges so that an upper end of the second portion of the laminar element is supported on an outer face of the flap.

9. A collapsible, self-expanding display unit comprising at least two opposite panels joined at their respective lateral edges and, which in a collapsed situation adopt a flat configuration, and in a service position adopt a convex configuration able to stand upright, and expansion means including at least one pull element to automatically expand said panels from said collapsed situation to said service position, wherein at least one of the panels comprises at least one cut defining an opening suitable for the passage of items and accessible from an outer face of the panel, said cut comprising at least one transverse cut section and at least two other cut sections and extending downwards from the ends of the transverse cut section in an inverted U shape defining a flap bent towards an upper part of the display unit along a lower bend line, at least one laminar element comprising a back portion, said back portion having an upper end attached to an inner side of the first panel at an upper edge of said transverse cut section of the cut, or under same, and a lower end attached to an inner side of the first panel near said lower bend line, retention member being provided connecting the back portion of the laminar element and the flap, thereby the back portion of the laminar element and the flap form a folder with an inlet communicated with said opening and suitable for housing, at least in part, said items.

10. A display unit according to claim 9, wherein said retention members comprise two folding lateral portions outwardly extending from opposite side edges of said back portion, said folding lateral portions having longitudinal bend lines and front edges attached at or near side edges of the flap.

11. A display unit according to claim 9, wherein upper and lower fixation flaps extend from upper and lower edges of the back portion to attach the laminar element to the panel.

12. A display unit according to claim 10, wherein front fixation flaps extend from said front edges of folding lateral portions to attach the folding lateral portions of the laminar element to the flap.

13. A pocket-like folder for a collapsible, self-expanding display unit comprising at least one upright panel made of a laminar material, wherein said pocket-like folder comprises:

a pivotable flap obtained from a cut formed in said panel, said cut defining an opening suitable for the passage of items and accessible from an outer face of the panel;

a laminar element arranged next to an inner face of the panel and having a first edge attached to the panel next to a folding line through which the flap pivots and an upper edge attached to the panel next to a portion of the cut defining an upper edge of the flap; and retention members connecting opposite sides of the laminar element to opposite sides of the flap, thereby the laminar element and the flap form a folder with an inlet communicated with said opening and suitable for housing, at least in part, said items.

14. The pocket-like folder according to claim 13, wherein said laminar element is a flexible element bent to form a pouch.

* * * * *

UNITED STATES PATENT AND TRADEMARK OFFICE

CERTIFICATE OF CORRECTION

PATENT NO. : 8,099,883 B2
APPLICATION NO. : 12/759181
DATED : January 24, 2012
INVENTOR(S) : Mestres Armengol et al.

It is certified that error appears in the above-identified patent and that said Letters Patent is hereby corrected as shown below:

On the Cover Page, Item [30], Foreign Application Priority Data, insert:

-- December 21, 2004 (ES).....200403034
April 14, 2004 (ES).....200500884
August 11, 2005 (ES).....200502025 --

Signed and Sealed this
Twelfth Day of June, 2012

David J. Kappos

David J. Kappos
*Director of the United States Patent and Trademark Office*